US006240998B1

(12) United States Patent
Miwa

(10) Patent No.: US 6,240,998 B1
(45) Date of Patent: Jun. 5, 2001

(54) WINDOW BLIND OPENING AND CLOSING DEVICE

(75) Inventor: Yuichi Miwa, Tokyo (JP)

(73) Assignee: Yugengaisha Misuzu, Tokyo (JP)

( * ) Notice: Subject to any disclaimer, the term of this patent is extended or adjusted under 35 U.S.C. 154(b) by 0 days.

(21) Appl. No.: 09/501,135

(22) Filed: Feb. 9, 2000

(30) Foreign Application Priority Data

Feb. 10, 1999 (JP) ..... 11-33472

(51) Int. Cl.[7] ..... E06B 9/36

(52) U.S. Cl. ..... 160/168.1 V; 160/176.1 V; 160/900

(58) Field of Search ..... 160/168.1, 169 R, 160/176.1 V, 173 V, 178.1 V, 900, 167 V

(56) References Cited

U.S. PATENT DOCUMENTS 3,079,988 * 3/1963 Green ..... 160/168.1 V
5,249,617 * 10/1993 During ..... 160/168.1 V
5,275,219 * 1/1994 Giacomel .
5,524,692 * 6/1996 John ..... 160/168.1 V
5,865,234 * 2/1999 Nakamura et al. .
6,073,672 * 6/2000 John ..... 160/168.1 V

* cited by examiner

*Primary Examiner*—Blair M. Johnson
(74) *Attorney, Agent, or Firm*—Sughrue, Mion, Zinn, Macpeak & Seas, PLLC

(57) ABSTRACT

A window blind opening and closing device can permit sequential drawing of louvers in a louver group from an end runner side opposite to the prior art to solve problems of damaging of runners and a drive shaft due to wearing, provide good appearance, and can open and close the window blind without interference even with the window blind using shaped louver in reversed S-shaped configuration in cross section. The opening and closing device includes a runner driving endless belt for driving the runners, runner connecting portions provided with a given interval on the runner driving endless belt, belt connecting pins provided in respective runners and movable between engaging positions to engage with the runner connecting portions and retracted positions released away from the runner connecting portions, springs for biasing respective of the belt connecting pins to the engaging positions for engaging with the runner connecting portion, receptacle openings on rear surfaces of respective runners, and belt connecting pins actuating projections provided on front surfaces of the runners and entering into the receptacle openings for driving the belt connecting pins to the retracted position against a force exerted by the spring a one preceding runner is stacked on a following runner.

11 Claims, 33 Drawing Sheets

WINDOW BLIND OPENING AND CLOSING DEVICE

BACKGROUND OF THE INVENTION

1. Field of the Invention

The present invention relates to an opening and closing device for a window blind, in which respective louvers are suspended on a plurality of runners, for closing the window blind by widening distances between the louvers in a louver group and opening the window blind by stacking the louvers in the louver group.

2. Description of the Related Art

Conventionally, in the window blind of this type, a top or lead runner is pulled by a drive cord to sequentially draw the louvers from one by one from the louver attached to the top runner for folding the louver to open the window blind.

Therefore, when the window blind is opened up halfway, the louvers in the louver group are moved in a condition where they are stacked at the leading end of the opening to cause substantial load on a drive shaft for opening and closing the window blind, to damage the runner and/or drive shaft by wearing, or to degrade appearance.

On the other hand, in general, when a tilt shaft is pivoted by pulling a tilt cord, a carrier of all of runners extending through the tilt shaft are rotated simultaneously to vary angles of the louvers all together. When the louvers are placed in closed condition, the louvers are partially overlapped in back and forth direction constantly as viewed from the front side.

When the louver is in normal flat plate shape, partial overlap of the louvers in back and forth direction causes overlap of flat planes. This is the same even when the orientation of the louvers are turned over by reversing the front and back surfaces of the louvers by pivoting about 180° all together by the tilt shaft. In either case, it is possible to open the window blind by sequentially pulling up the louver of the top runner. On the other hand, since partial overlap of the louvers in back and forth direction is overlap of the flat planes, to be substantially the same closed condition, therefore light blocking effect and continuity of color and/or pattern as viewed from the front side are not varied.

However, as disclosed in Japanese Examined Utility Model Publication No. Heisei 7-14623, in case of the window blind, in which the louver is curved in opposite direction in left and right halves to be formed into cross-sectionally reversed S-shaped configuration in order to provide wavy solid appearance, louvers are overlapped with fitting the curves with each other as shown in FIG. 1A. On the other hand, when the front and back surfaces of the louvers 4 are reversed by pivoting in the direction shown by arrow over about 180° all together by the tilt shaft, curves are mated in back-to-back relationship as shown in FIG. 1B. In either case of FIGS. 1A and 1B, when the window blind is opened by pulling from the louver coupled with the top runner in these conditions, a difficulty is encountered. Also, gaps are formed between adjacent louvers to cause degradation of light blocking effect. Furthermore, the gaps are perceived as large step as viewed from the front side to potentially degrade continuity of color and/or pattern.

In the condition shown in FIG. 1B, it becomes possible to establish overlapping direction with fitting the curves similarly to FIG. 1A, by further pivoting the louvers 4 in the same direction to forcedly switch back and force positional relationship of portions mutually located in back to back relationship. However, by simultaneous pivot motion by the tilt shaft, it is not possible to reverse the louver all together to the position where the back and forth positional relationship of the portions of the louvers is switched. Therefore, it is not possible to reverse the louvers to the position same as FIG. 1A.

SUMMARY OF THE INVENTION

It is the first object of the present invention to provide a window blind opening and closing device which can permits sequential drawing of louvers in a louver group from an end runner side opposite to the prior art to solve problems of damaging of runners and a drive shaft due to wearing, can provide good appearance, and can open and close the window blind without interference even with the window blind using shaped louver in reversed S-shaped configuration in cross section.

It is the second object of the present invention to establish the same condition as reversed front and back surfaces of the louver as the condition where the louvers are not reversed even with the window blind using shaped louver in reversed S-shaped configuration in cross section.

According to the present invention, an opening and closing device for a window blind, in which louvers are hanged on carriers respectively carried by runners in a runner group traveling along a rail for opening and closing the group of louvers, and the carriers are rotated by a tilt shaft extending through the runner group for varying orientation of the louvers in unison, comprises:

a runner driving endless belt for driving an endless belt;

runner connecting portions provided with a given interval on the runner driving endless belt;

belt connecting pins provided in respective runners and movable between engaging positions to engage with the runner connecting portions and retracted positions released away from the runner connecting portions;

springs for biasing respective of the belt connecting pins to the engaging positions for engaging with the runner connecting portion;

means for defining receptacle openings on rear surfaces in traveling direction of respective runners; and belt connecting pins actuating projection provided on front surfaces of the runners and entering into the receptacle openings to drive the belt connecting pins to the retracted position against a force exerted by the spring when one preceding runner is stacked on one runner.

With the construction set forth above, by driving the runner driving endless belt to circulate in one direction to stop the end runner at first. Then, the second runner approaches the end runner to be stacked thereon. Into the receptacle opening of the second runner, the belt connecting pin actuating projection is projected to drive the belt connection pin of the second runner to retract to release from the runner connecting portion of the runner driving endless belt to stop the second runner in the condition stacked with the end runner. The runner driving endless belt is further driven in the same direction to circulate to stop the third runner with neatly stacking on the second runner. Into the receptacle opening of the third runner, the belt connecting pin actuating projection is projected to drive the belt connection pin of the third runner to retract to release from the runner connecting portion of the runner driving endless belt to stop the third runner in the condition stacked with the end runner.

Accordingly, the louver group can be sequentially folded forwardly from the end runner.

In the preferred construction, the runner connecting portions of the runner driving endless belt may be holes.

A pinion rotatable about the tilt shaft for varying orientation of the louvers in the louver group in unison and a cam for rotating the pinion with engaging with the belt connecting pin actuating projection projecting from the receptacle opening, may be provided within each runner and a rack portion meshing with the pinion may be provided on the belt connecting pin. Also, a cam engaging with the belt connecting pin actuating projection projecting from the receptacle opening for retracting the belt connecting pin against the spring, may be provided in the belt connecting pin.

An end stopper is fixed to one end in the rail and a belt connecting pin actuating projection may be provided for retracting the belt connecting pin by projecting into the end runner into the receptacle opening.

A runner restricting stopper is provided on a top runner arranged at the leading end among the runners for restricting travel of the top runner relative to the rail and releasing from restricted state, and stopper actuating member may be provided on the top runner for actuating the runner restricting stopper to a travel restricting position when the louvers may be oriented in closing orientation (in the orientation to be parallel to the axis of the rail) and for actuating the runner restricting stopper to released position when the louver may be oriented in opening orientation (in the orientation intersecting with the axis of the rail).

In order to achieve the second object a propeller may be fixed on the carrier of each runner, and louver reversing member may be projected from a louver reversing endless belt which can circulate along the rail for sequentially rotating each individual carrier together with the propeller by colliding with the propeller.

With such construction, when the louver reversing endless belt is circulated, the louver reversing member projected from the louver reversing endless belt sequentially collides on the propeller of the carriers of the runner group to sequentially rotates respective individual carrier without using the tilt shaft. Thus, the louvers can be reversed the front and rear surfaces individually in one-by-one basis.

In order to assure reversal of the louver by the louver reversing member, a propeller rotation stopper restricting rotation of the propeller at an orientation with a given angle relative to the rail may be provided on each runner, and a propeller stopper releasing member releasing the propeller rotation stopper to permit rotation of the propeller may be provided on the louver reversing member.

The louver reversing endless belt may be wound around sprocket wheels rotatably supported on the rail, a louver reversal restricting stopper for restricting rotation of the sprocket and releasing restriction is provided on the rail, and a stopper releasing member for retracting the louver reversal restricting stopper to a released position is provided on the top runner. When the window blind is to be opened, the louvers in the louver group can be drawn frontwardly from the end runner side sequentially conversely from the prior art, a problem of damaging of the runner or the drive shaft due to wearing can be resolved to provide good appearance when the window blind is opened to the midway A runner restricting stopper which can restrict travel of the top runner relative the rail and releasing restriction is provided on the top runner and a stopper actuating member may be provided on the carrier of the top runner for actuating the runner restricting stopper to traveling restricting position when the louver is oriented in closing orientation (orientation to be parallel to the axis of the rail) and for actuating the runner restricting stopper to released position when the louver is oriented in opening orientation (orientation to intersect with the axis of the rail).

The louver may be reversed S shaped cross section.

BRIEF DESCRIPTION OF THE DRAWINGS

The present invention will be understood more fully from the detailed description given hereinafter with reference to the accompanying drawings of the preferred embodiment of the present invention, which, however, should not be taken to be limitative to the present invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure are not shown in detail in order to avoid unnecessary obscurity of the present invention.

Figure 2:
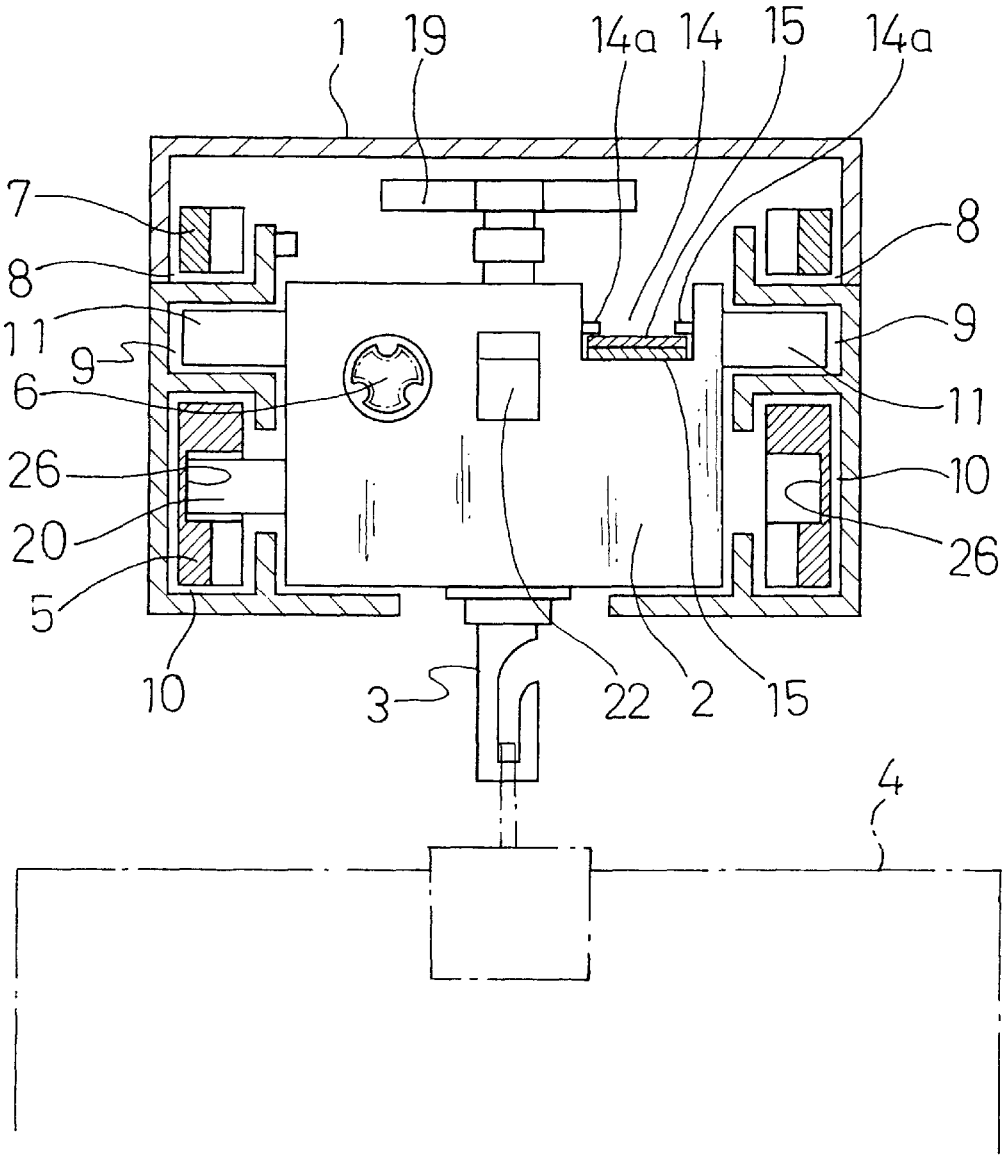
FIG. 2 is a section of a rail, a runner and a belt in the preferred embodiment of the present invention.
Figure 3:
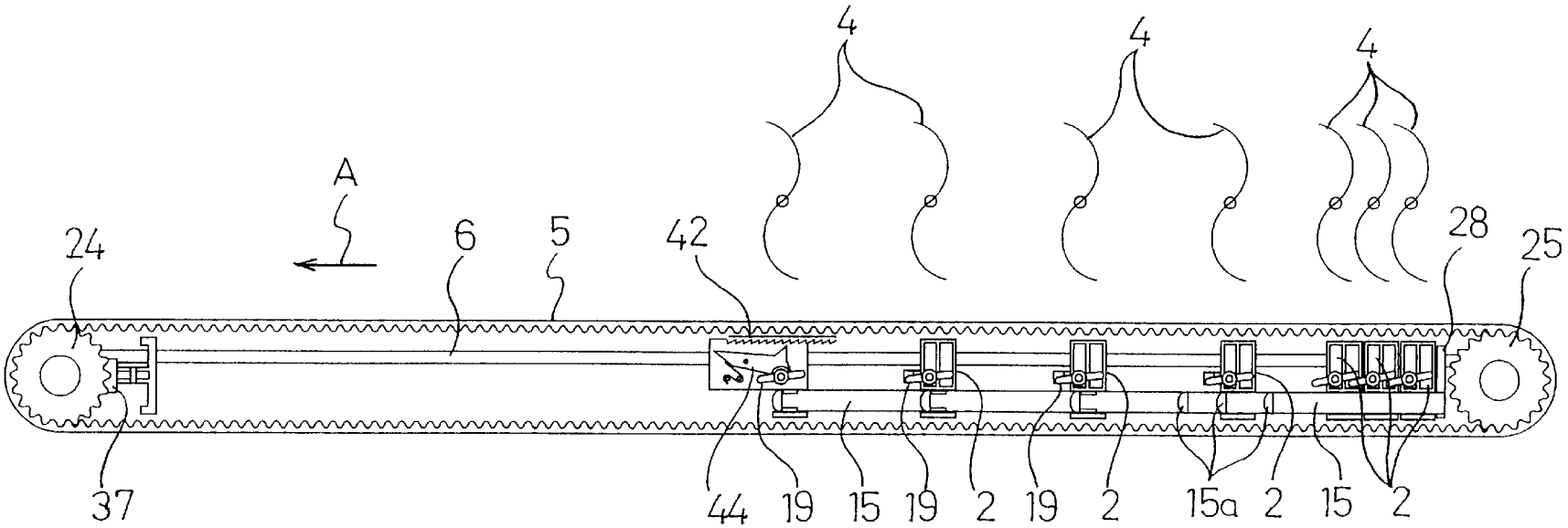
FIG. 3 is a general plan view of the preferred embodiment of the present invention where a top runner is traveled to a midway, in which the louver is illustrated separately from the runner.
Figure 4:
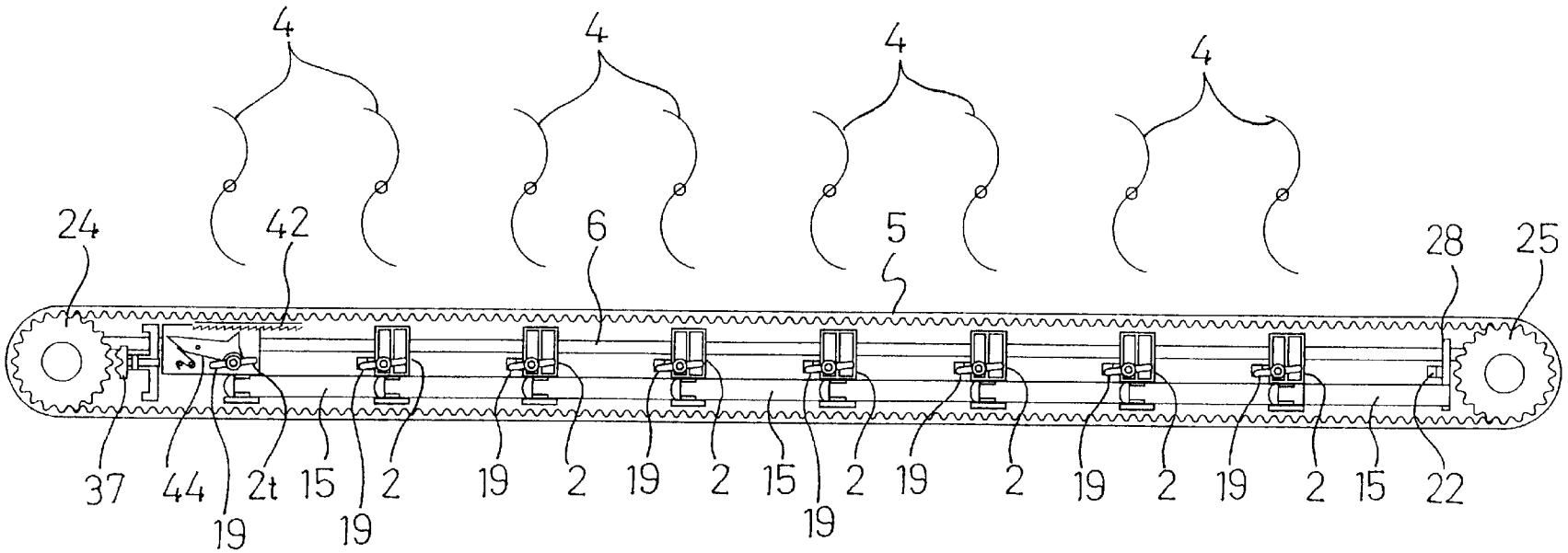
FIG. 4 is a plan view similar to FIG. 3, but showing a condition where the top runner is traveled to a terminal end.
Figure 5:
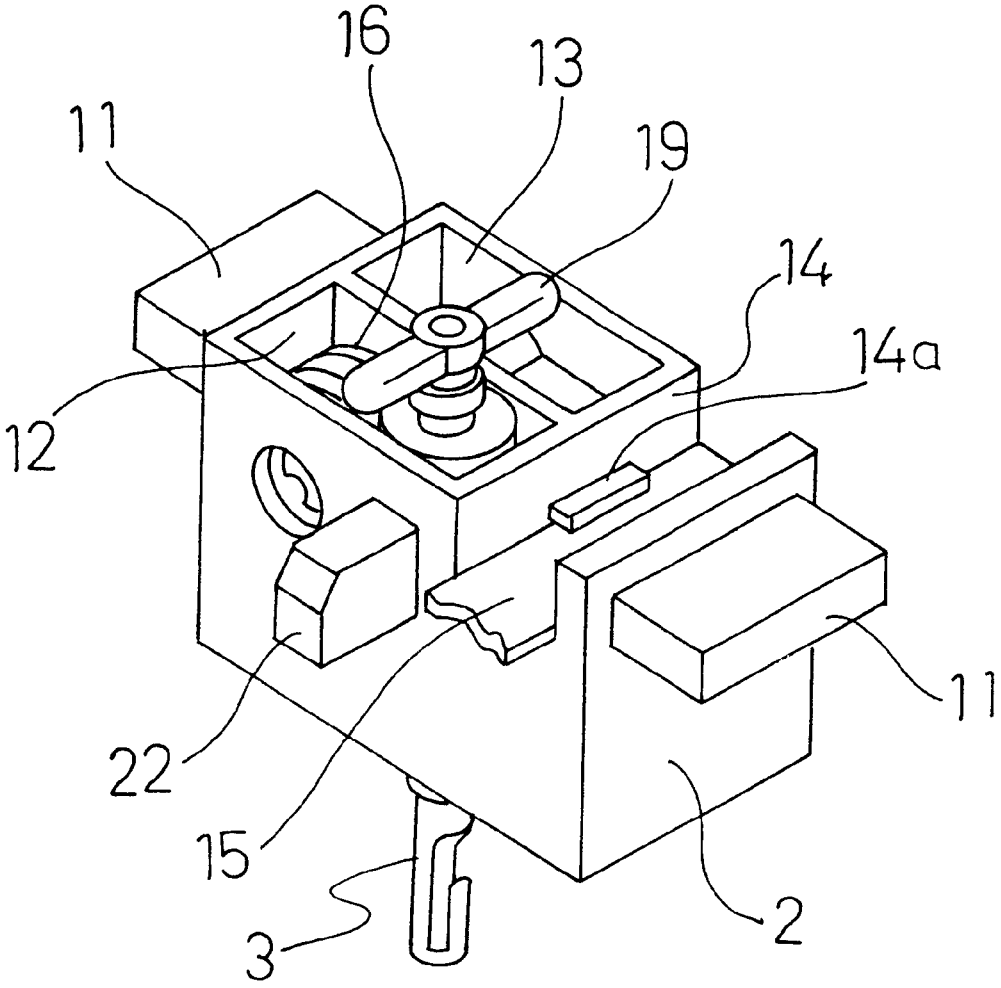
FIG. 5 is a perspective view of an individual runner.
Figure 6:
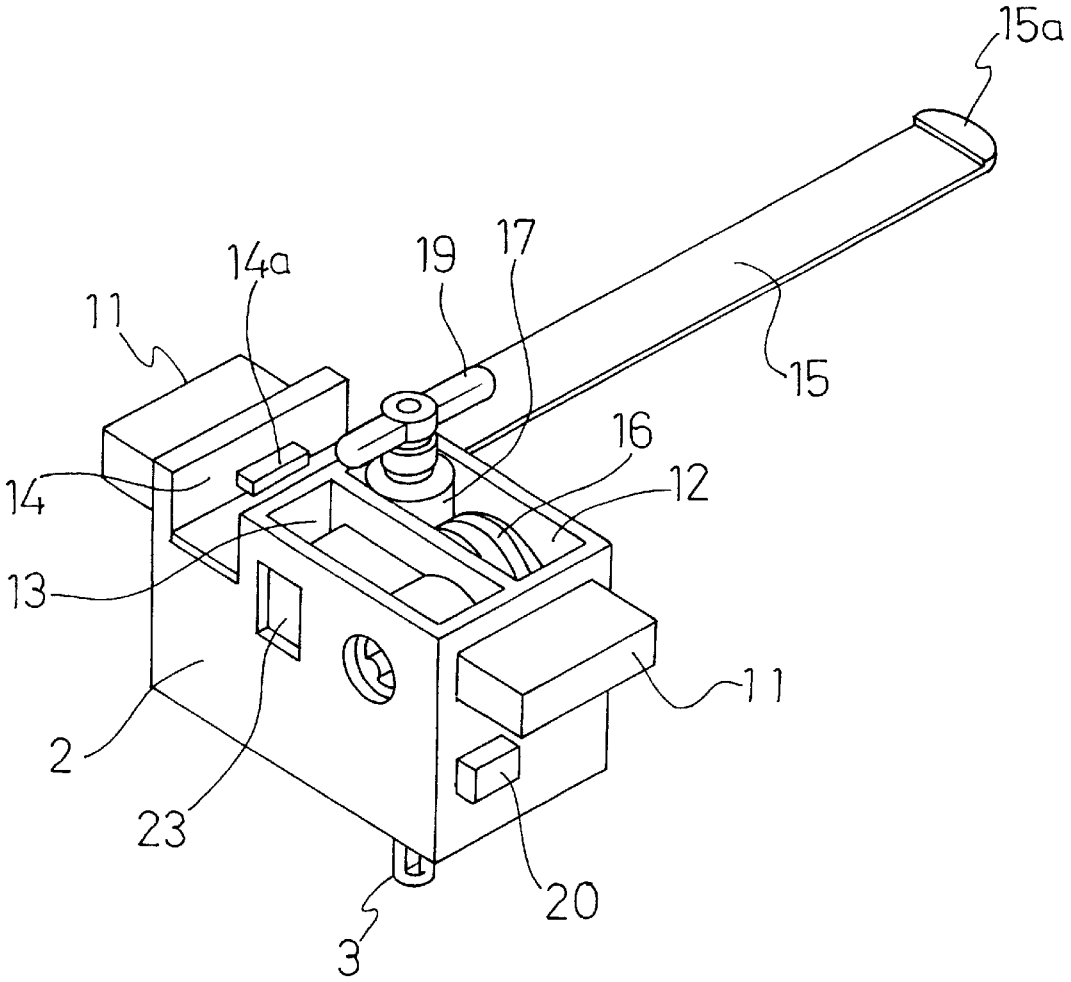
FIG. 6 is a perspective view as viewed from opposite side to FIG. 5.
Figure 7:
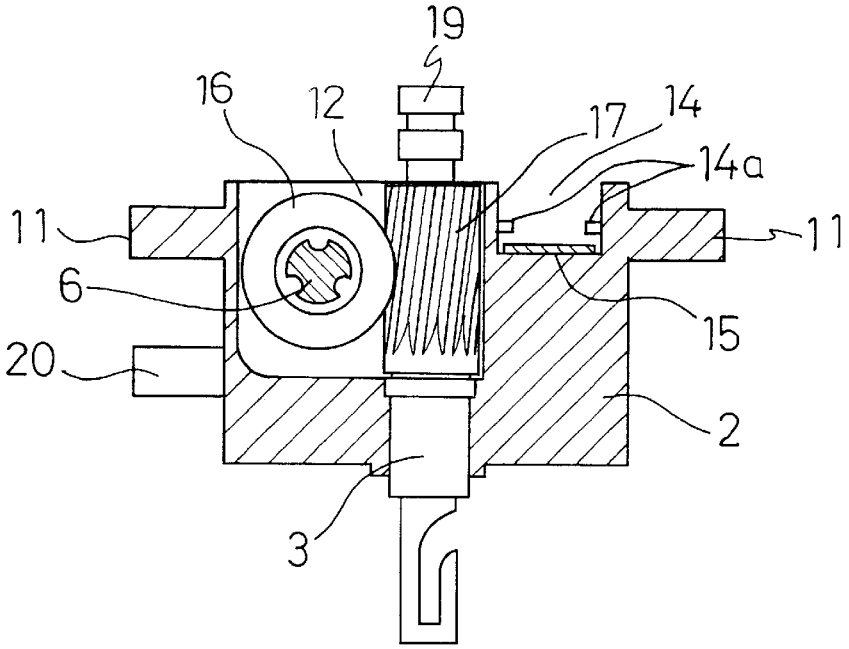
FIG. 7 is a sectional view of the individual runner.
Figure 8:
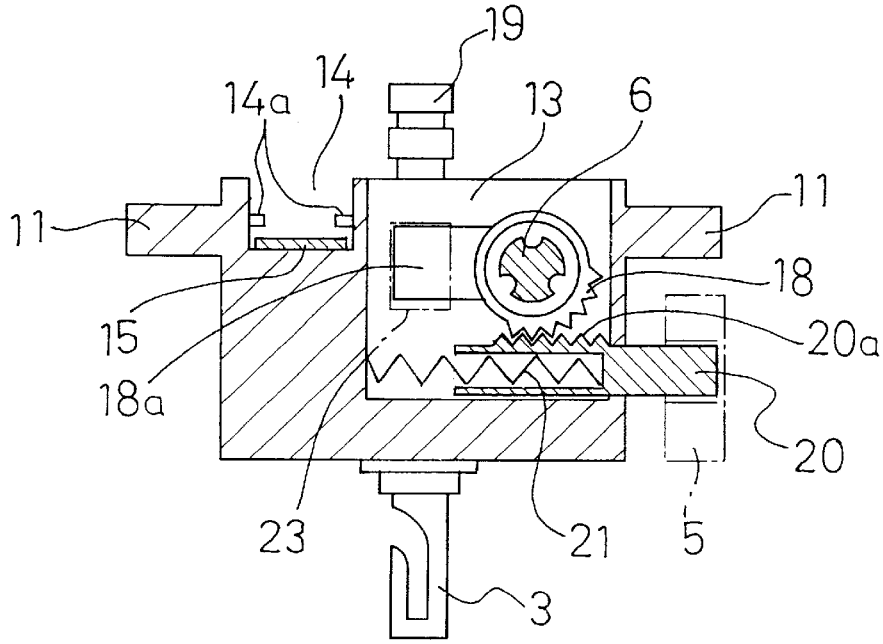
FIG. 8 is a section of a position different from the portion shown in FIG. 7.
Figure 9:
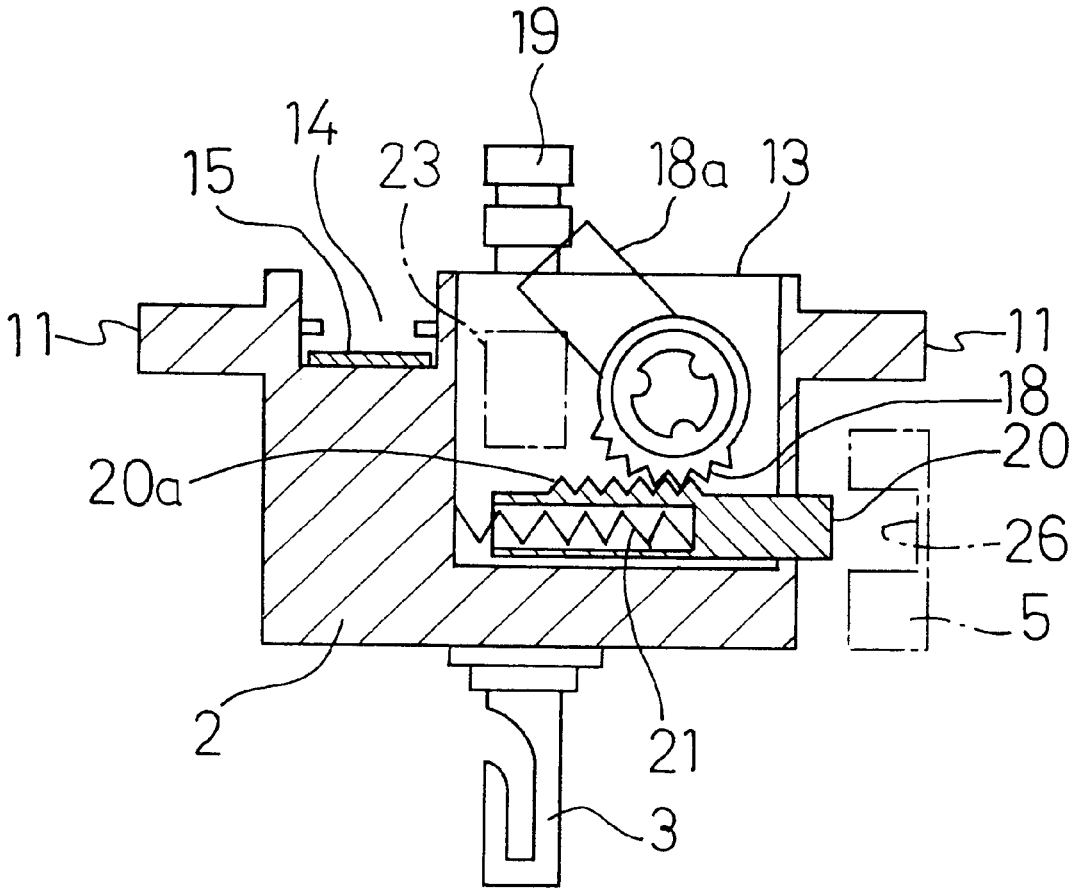
FIG. 9 is a section showing a condition where a belt connecting pin is retracted from the condition shown in FIG. 8.

At first, a general construction of the preferred embodiment of a window blind will be discussed. As shown in FIG. 2, a plurality of runners 2 in a form shown in FIGS. 5 and 6, are mounted within a box shaped rail 1 in slidable fashion. A carrier 3 mounted on each individual runner 2 suspends a louver 4. A group of runners 2 may slidingly travel along the rail 1 by means of an endless belt 5 for driving the runner, which endless belt circulates within the rail 1. On the other hand, by means of a tilt shaft 6 extending through all of runners 2, all of the carriers 3 carried by respective runners 2 are rotated simultaneously for varying orientation of all of the louvers 4 all together. Furthermore, by means of an endless belt 7 for reversing the louver, which endless belt circulates within the rail 1, the carriers 3 carrying respective louvers 4 are individually rotated sequentially to reverse orientation of the louvers 4 one by one. As shown in FIG. 3, each louver 4 has a reversed S shaped cross section. In plan views in FIGS. 3 and 4, orientation of the group of louvers 4 relative to the group of runners 2 are shown separately from the group of the runners 2.

Figure 1A:
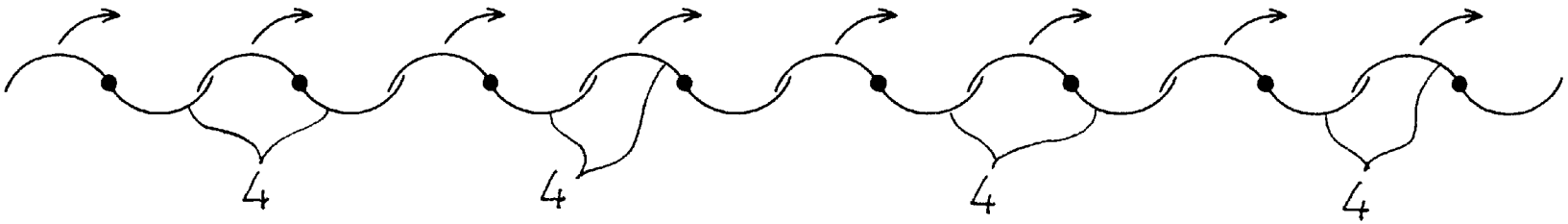
FIGS. 1A and 1B are plan views showing variation of overlapping of louvers when a window blind with cross-sectionally reversed S shaped louvers is reversed front surface and back surface from a condition shown in FIG. 1A to a condition shown in FIG. 1B.
Figure 1B:
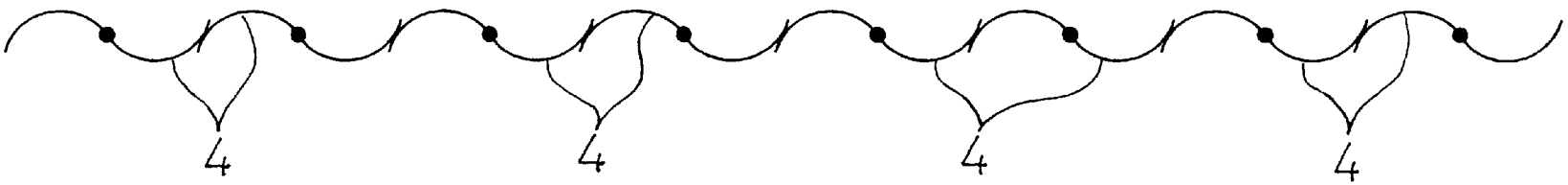
Figure 14:
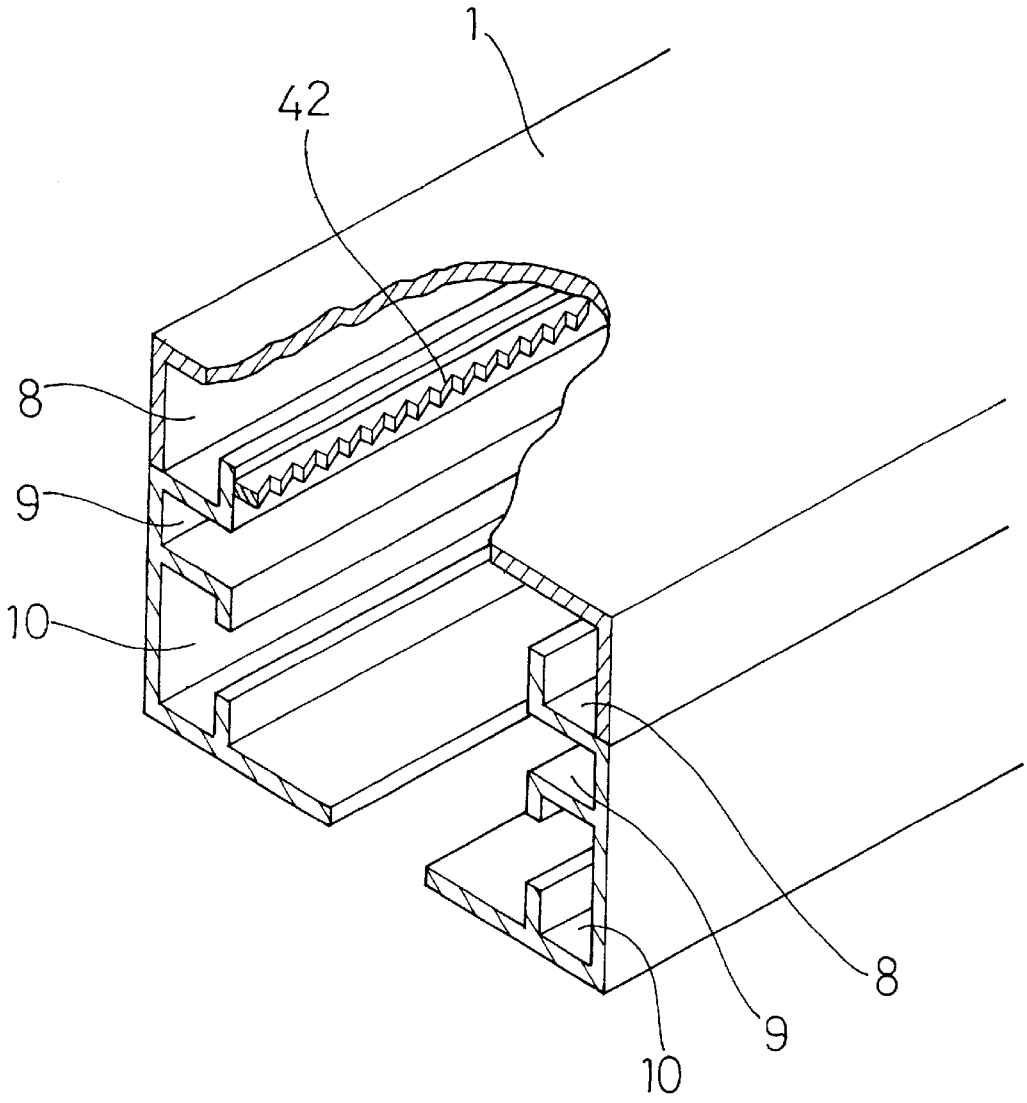
FIG. 14 is a perspective view where the rail is cut out.
Figure 15:
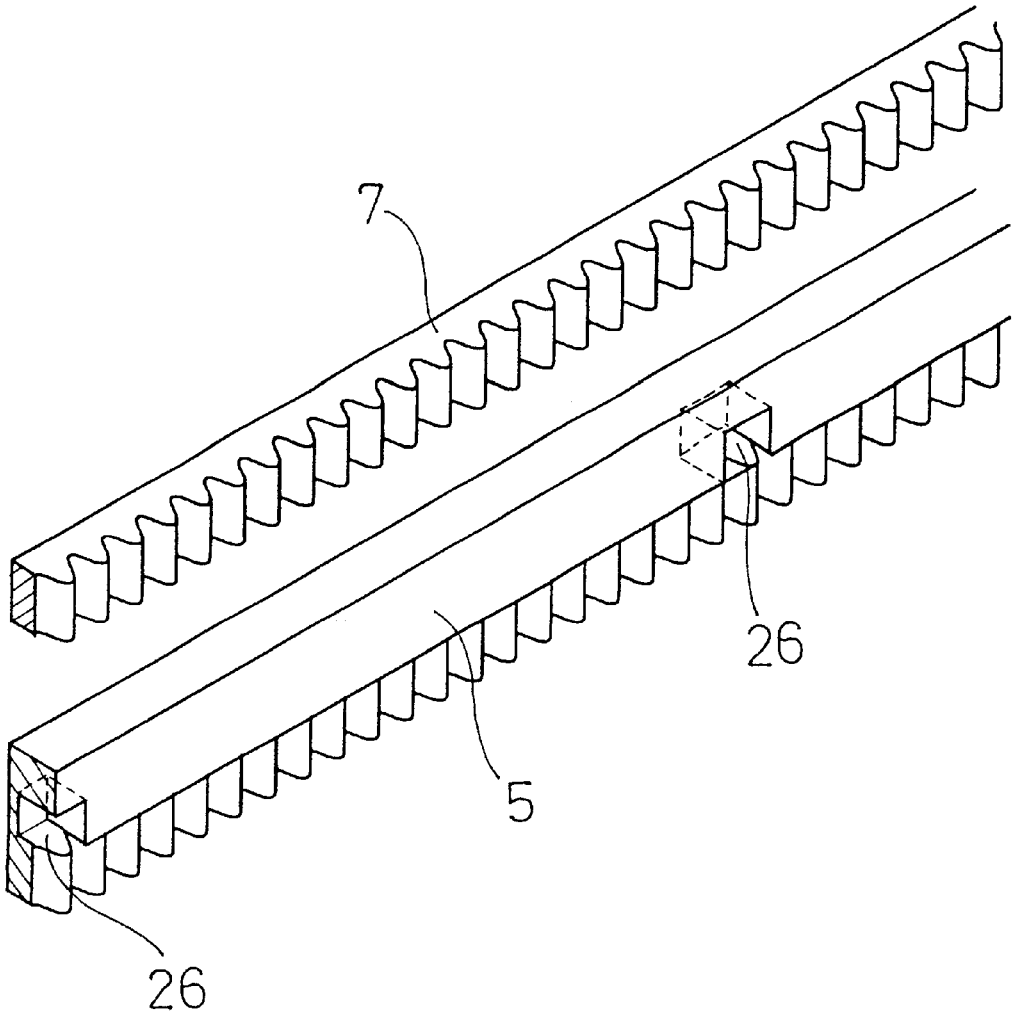
FIG. 15 is a partial perspective view of an endless belt for driving the runner forward and an endless belt for reversing louver.

The rail 1 is molded into the boxed shaped configuration with aluminum and defines three stages of guide portions on both sides as shown in FIGS. 1 and 14. Namely, the rail 1 defines an upper belt guide portion 8 guiding the endless belt 7 for reversing the louvers, an intermediate runner guide portion 9 for guiding the group of the runners 2, and a lower belt guide portion 10 for guiding the endless belt 5 for driving the runners. In FIG. 15, parts of the endless belt 5 for driving the runners and the endless belt 7 for reversing the louvers are shown. The group of runners 2 are mounted within the rail 1 for sliding movement in horizontal direction by slidably engaging the projecting portions 11 on both side surfaces with the runner guide portion 9. It should be noted that rollers rotating within the runner guide portion 9 may be rotatably supported on the runners 2 in place of the projecting portion 11.

Each runner 2 is molded into a box shaped configuration with a resin as shown in FIGS. 5 and 6 and defines a carrier rotating mechanism chamber 12 and a belt connecting pin projecting and retracting mechanism chamber 13 in alignment along the runner traveling direction, and further defines a connecting recess portion 14. As is well known, the group of runners 2 are chained with each other with a given interval by engaging a tip end claw portion 15*a* of a connecting piece 15 projecting from own connecting recess portion 14 with a projection 14*a* in the connecting recess portion 14 of the adjacent runner 2 as shown in FIGS. 3 and 4.

In the following description, a direction to which the group of louvers 4 are extracted by increasing distances between the runners 2 and whereby closing the window blind (toward left in FIGS. 3 and 4) will be referred to as forward, and a direction to which the group of louvers 4 are retracted by reducing the distances between the runners 2 and whereby opening the window blind will be referred to as backward (toward right in FIGS. 3 and 4).

Within the carrier rotating mechanism chamber 12 of each runner 2, a worm gear 16 formed integrally with the tilt shaft 6 extending therethrough and a part of the carrier 3 are housed. The worm gear 16 meshes with a worm gear 17 provided on the carrier 3. When the tilt shaft 6 is rotated, the carriers 3 of all of the runners 2 are rotated in unison in per se known manner.

Within the belt connecting pin projecting and retracting mechanism chamber 13, a pinion 18, through which the tilt shaft 6 extends, rotatable about the latter, a cam 18*a* provided integrally with the pinion 18, a belt connecting pin 20 having a rack portion 20*a* meshing with the pinion 18 to be projected and retracted associating with rotation of the pinion 18, and a spring 21 for biasing the belt connecting pin 20 in projecting direction.

On the front surface of each runner 2, the belt connection pin actuating projection 22 for actuating the belt connection pin 20 of one preceding runner 2 is projected integrally, as shown in FIG. 5. On the back surface of each runner 2 as opposite surface, a receptacle opening 23 is formed for accommodating a tip end portion of the belt connection pin actuating projection 22 of immediately trailing runner 2 within the belt connection pin projecting and retracting mechanism chamber 13 for engagement with the cam 18*a,* as shown in FIG. 6.

On the other hand, the endless belt 5 for driving the runner on the rail side is wound around sprocket wheels 24 and 25 rotatably supported at both end portions of the rail 1 as shown in FIGS. 3 and 4. By operating a not shown opening and closing cord for driving one (right side in the drawing) of the sprocket wheel 25, the endless belt 5 is circulated along the lower belt guide portion 10. On the endless belt 5 for driving the runner, as the runner connecting portion engaging the belt connection pins 20 for connecting the endless belt 5 for driving the runner and the runners 2, a plurality of runner connection holes 26 are provided at regular interval (corresponding to the interval of the connecting pieces 15) for accommodating the tip end portion of respective belt connection pins 20 in releasable fashion.

Figure 10:
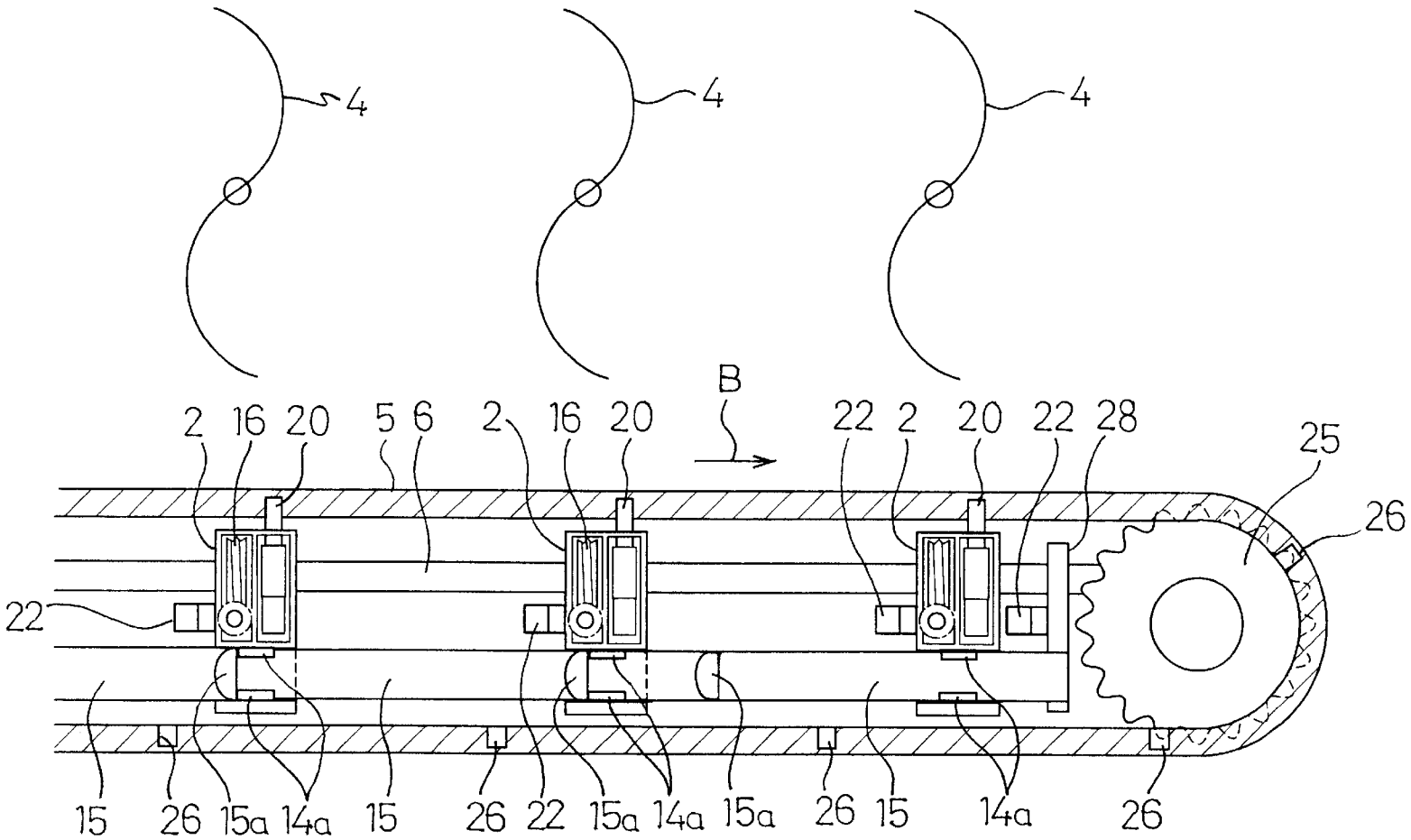
FIG. 10 is a partial plan view showing manner of sequentially moving runner group backwardly for opening the window blind.

On the other hand, as shown in FIG. 10, in the vicinity of the right side sprocket wheel 25, an end stopper 28 which is not movable, is fixedly provided. Even on the end stopper 28, the belt connection pin actuating projection 22 and the connecting piece 15 are projected in the similar manner as the belt connection pin actuating projection 22 of the runner 2. The end stopper 28 extends through the tilt shaft 6.

Accordingly, when the endless belt 5 for driving the runner for closing the window blind is circulated in the direction of arrow A of FIG. 3, the runner 2 projecting the belt connection pin 20 into the runner connection hole 26 sequentially travels frontwardly as being drawn by the endless belt 5 driving the runner. When the window blind is fully closed up to the terminal end, the belt connection pin 20 of all runners 2 in the runner group is arranged in equal interval with projecting the belt connection pins 20 into the runner connection holes 26.

Figure 11:
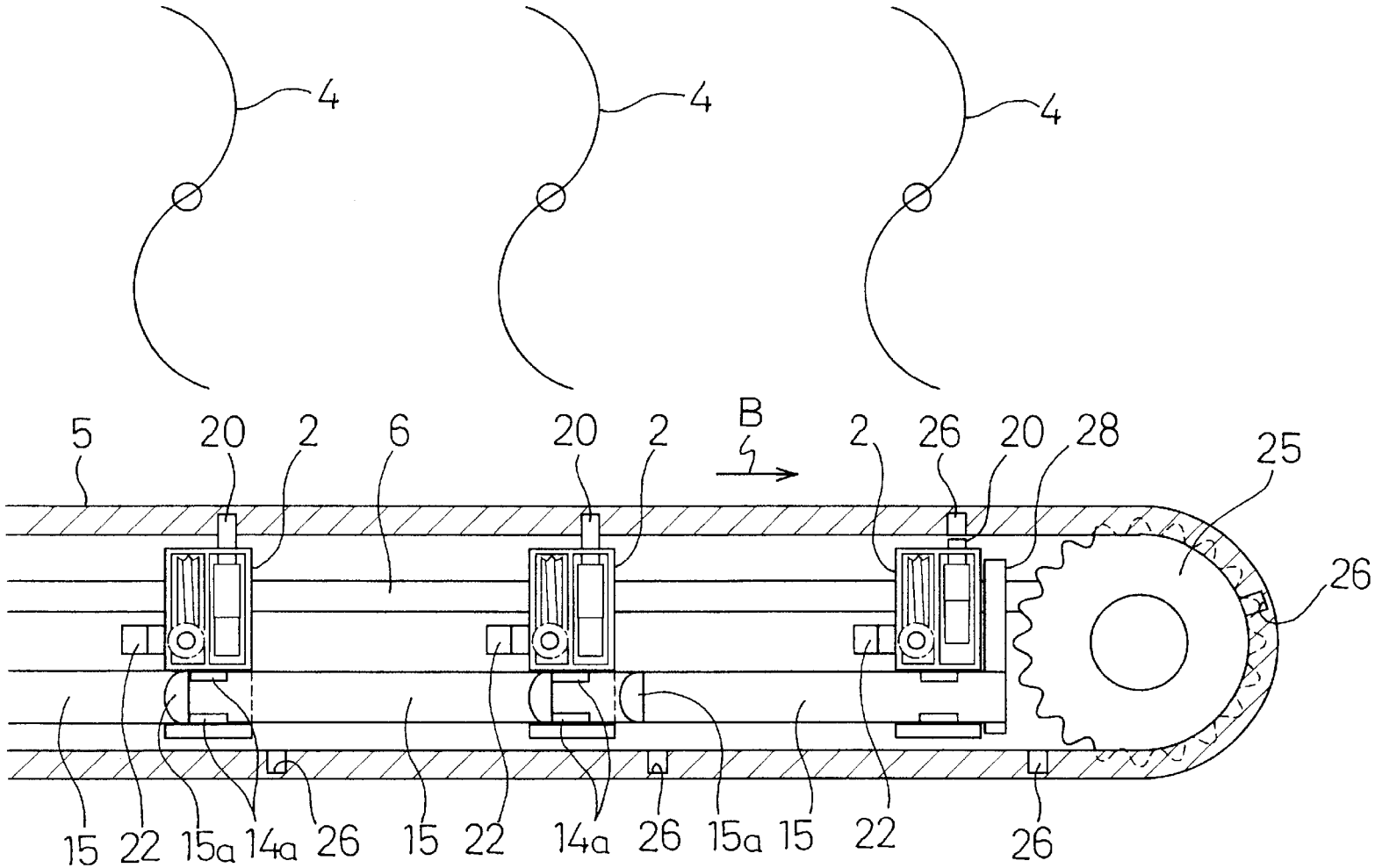
FIG. 11 is a plan view of the condition where the runner is moved further backwardly from the position shown in FIG. 10.
Figure 12:
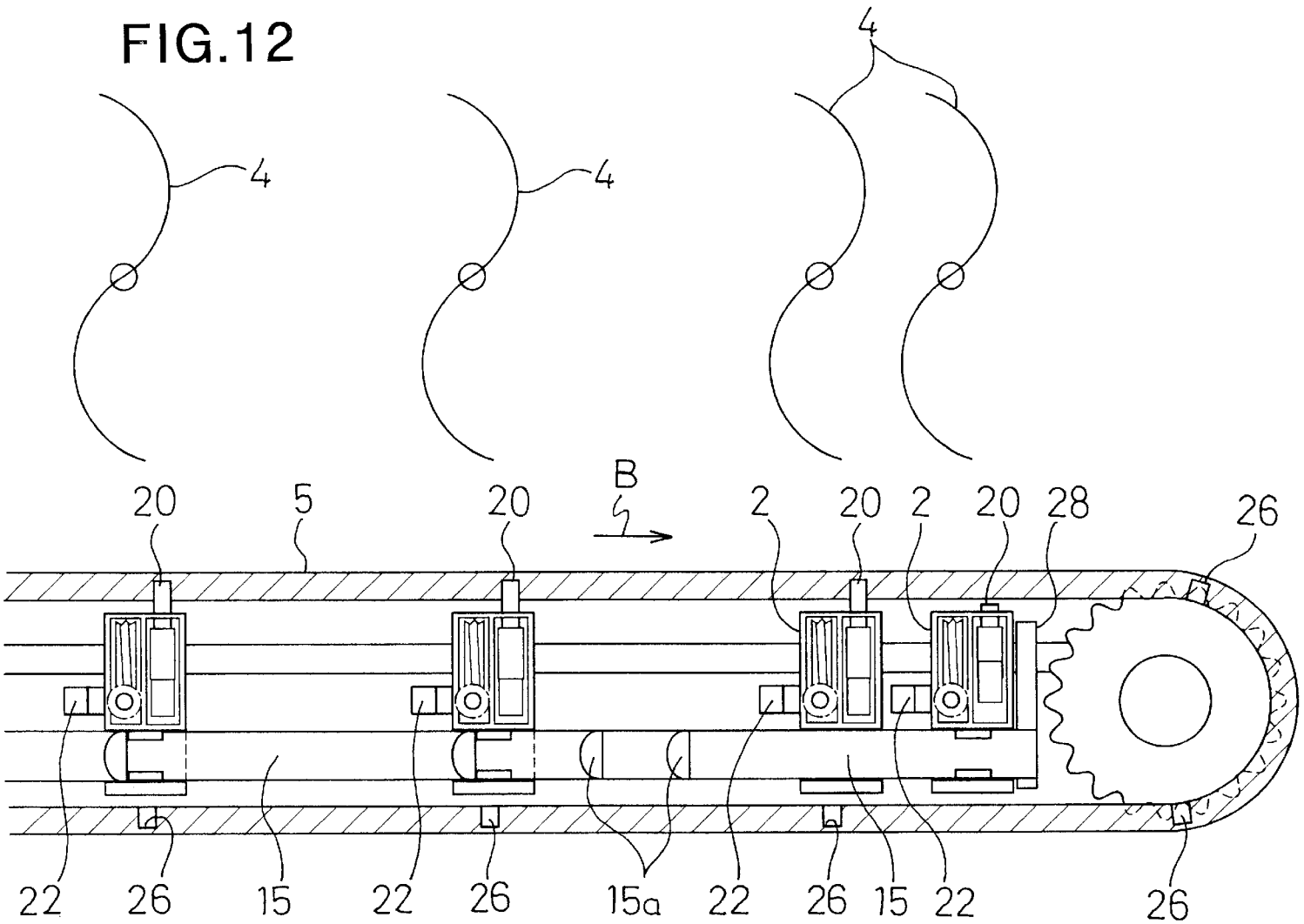
FIG. 12 is a plan view of the condition where the runner is moved further backwardly from the position shown in FIG. 11.

On the other hand, when the endless belt 5 for driving the runner is circulated in the direction of arrow B in FIG. 10 for opening the window blind, the runners 2 in the runner group are driven to travel backwardly. At first, associating with collision of the end runner 2 located at the rearmost position (right end) with the end stopper 28 as shown in FIG. 11, the belt connection pin actuating projection 22 of the end stopper 28 enters into the receptacle opening 23 of the end runner 2 to engage with the cam 18*a.* Then, the pinion 18 rotates about the tilt shaft 6. The belt connection pin 20 is then released from the runner connection hole 26 against a biasing force of the spring 21. Therefore, the end runner 2 at the rearmost position is initially separated from the endless belt 5 for driving the runner to stop as shown in FIG. 12.

Figure 13:
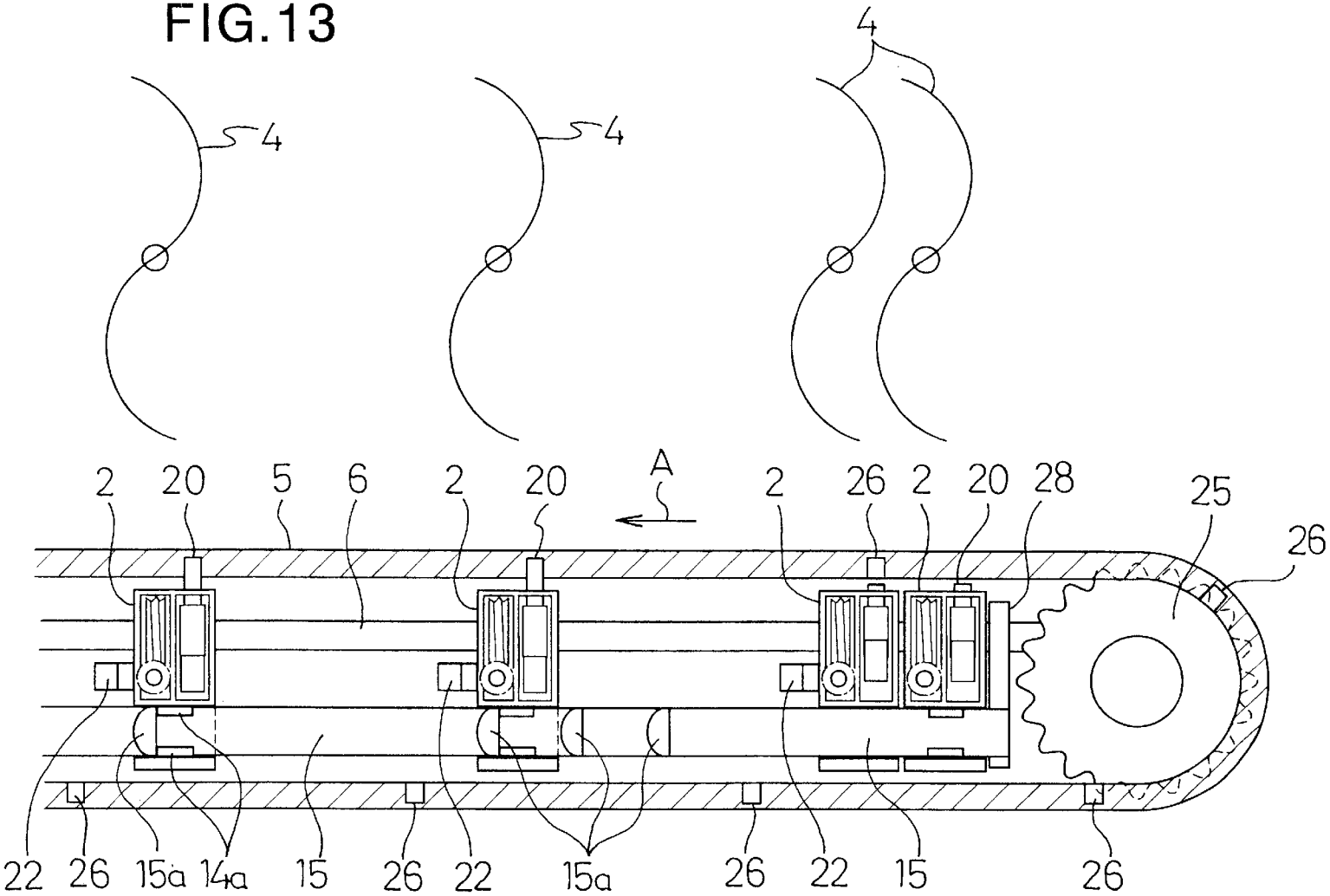
FIG. 13 is a plan view of the condition where the runner is moved further backwardly to overlap two runners.

To the first end runner 2 which is stopped, the second runner 2 collides as shown in FIG. 13. Then, the belt connection pin actuating projection 22 of the first end runner 2 projects into the receptacle opening 23 of the second runner 2. Thus, similarly, the connecting pin 20 is released from the runner connection hole 26 to separate the second runner 2 from the endless belt 5 for driving the runner to stop.

Then, per every time of stacking of the runners 2, the operation set forth above is performed sequentially in one-by-one basis. Therefore, the group of louvers 4 are sequentially folded from the rear end (from right end) instead of folded from the front end as in the prior art as shown in FIGS. 10 to 13.

From the thus folded condition, the endless belt 5 for driving the runner is circulated in the direction of arrow A as shown in FIG. 13. Then, the runner 2 which maintains the belt connection pin 20 thereof projecting into the runner connection hole 26 is driven frontwardly as drawn by the endless belt 5 for driving the runner to be placed in a condition where the immediately trailing runner 2 is drawn through the connecting piece 15. The belt connection pin actuating projection 22 of further immediately trailing runner 2 is withdrawn from the receptacle opening 23 of the immediately trailing runner 2. Therefore, the belt connection pin 20 of the drawn runner 2 is placed in a condition again projected by the action of the spring 21 to project the endless belt 5 for driving the runner 2 into the next runner connection hole 26. Then, the runner 2 is drawn by the endless belt 5 for driving the runner 2 via the connecting piece 15.

Since such operation is sequentially transferred to the following runner 2, the group of the louvers 4 transits from the state of FIG. 13 to respective states of FIGS. 12, 11 and 10 to close the window blind.

Next, discussion will be given for the mechanism to reverse the orientation of the cross-sectionally S-shaped louvers 4 for reversing front and rear surfaces.

On the upper end of the carrier 3 of each runner 2, two vane propeller 19 is fixed to the carrier 3 for integral rotation therewith in the orientation intersecting with the orientation of the louver 4, as shown in FIGS. 5 and 6.

Figure 16:
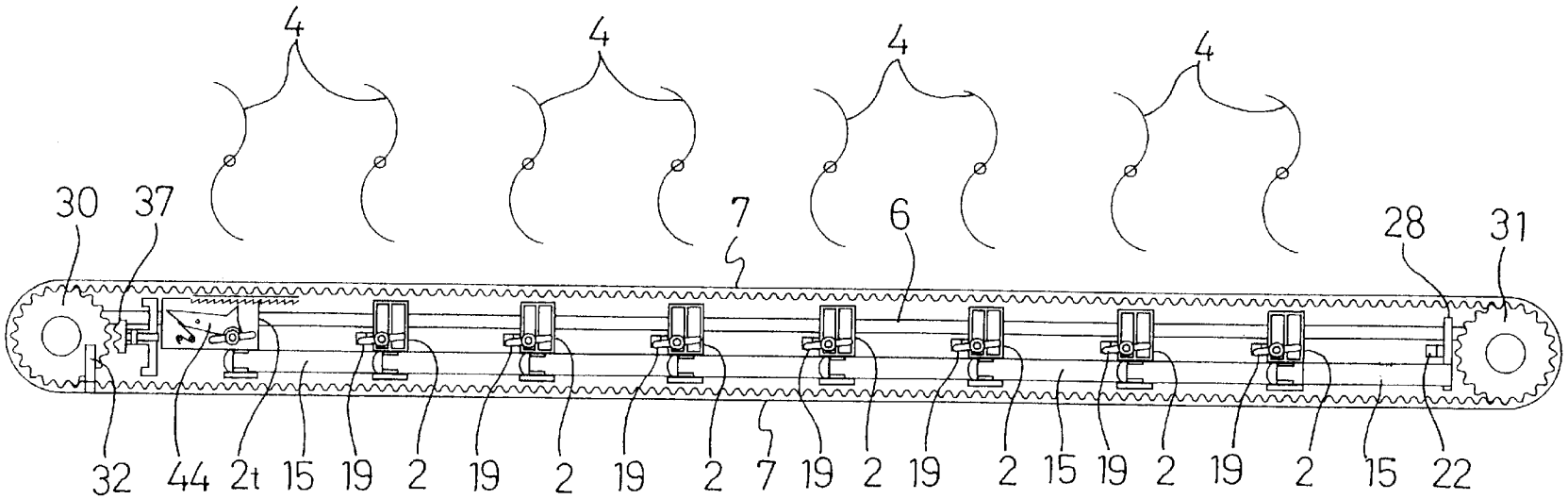
FIG. 16 is a general plan view in a condition where the top runner is traveled to the terminal end to orient the louver in the direction intersecting with the tilt shaft.

On the other hand, the endless belt 7 for reversing the louver on the rail side is wound around sprocket wheels 30 and 31 rotatably supported at both end portions of the rail 1 as shown in FIG. 16. By operating a not shown louver reversing cord for driving one (right side in the drawing) of the sprocket wheel 31, the endless belt 7 is circulated along the upper belt guide portion 8.

Figure 17:
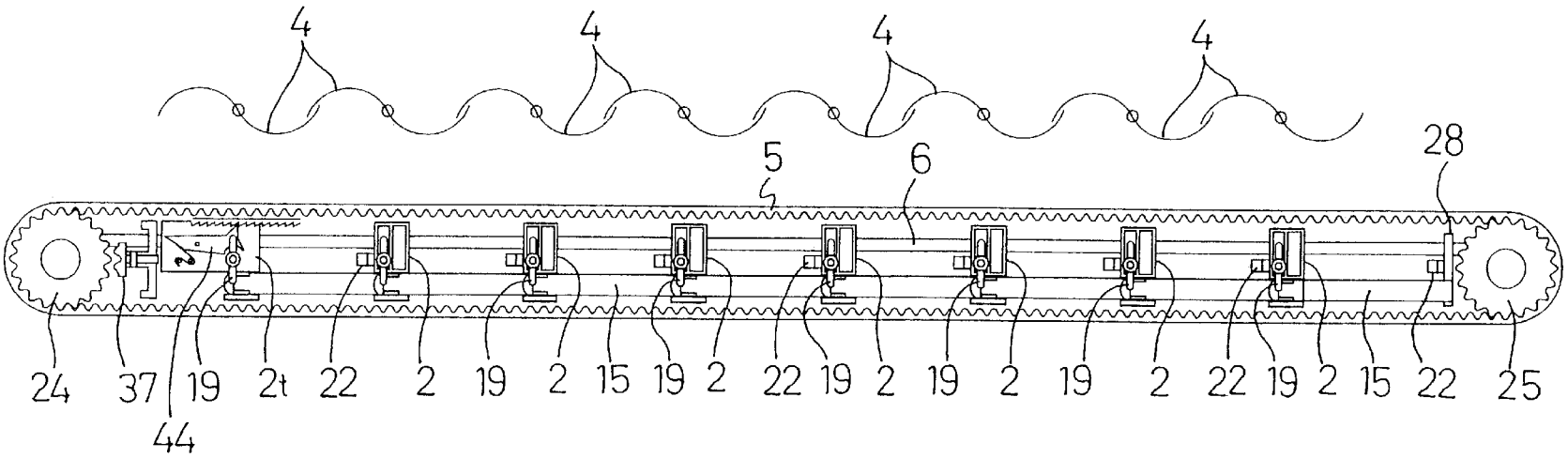
FIG. 17 is a general plan view in a condition where the top runner is traveled to the terminal end to orient all of the louver in the direction in parallel to the tilt shaft.
Figure 18:
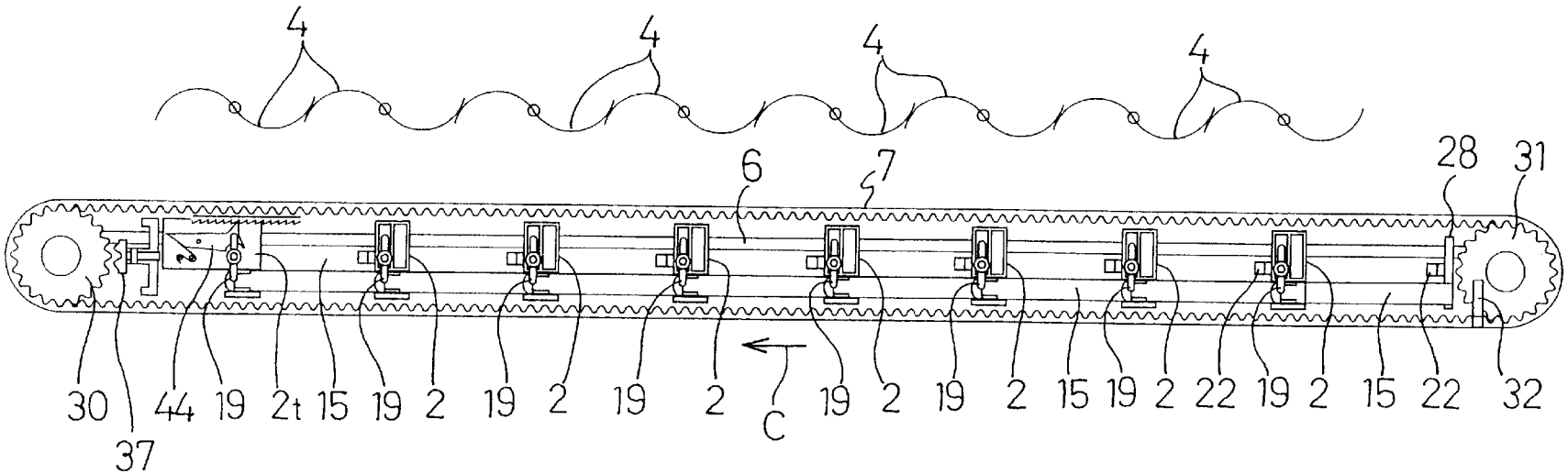
FIG. 18 is a general plan view where all of the louvers are reversed from the condition shown in FIG. 17.
Figure 19:
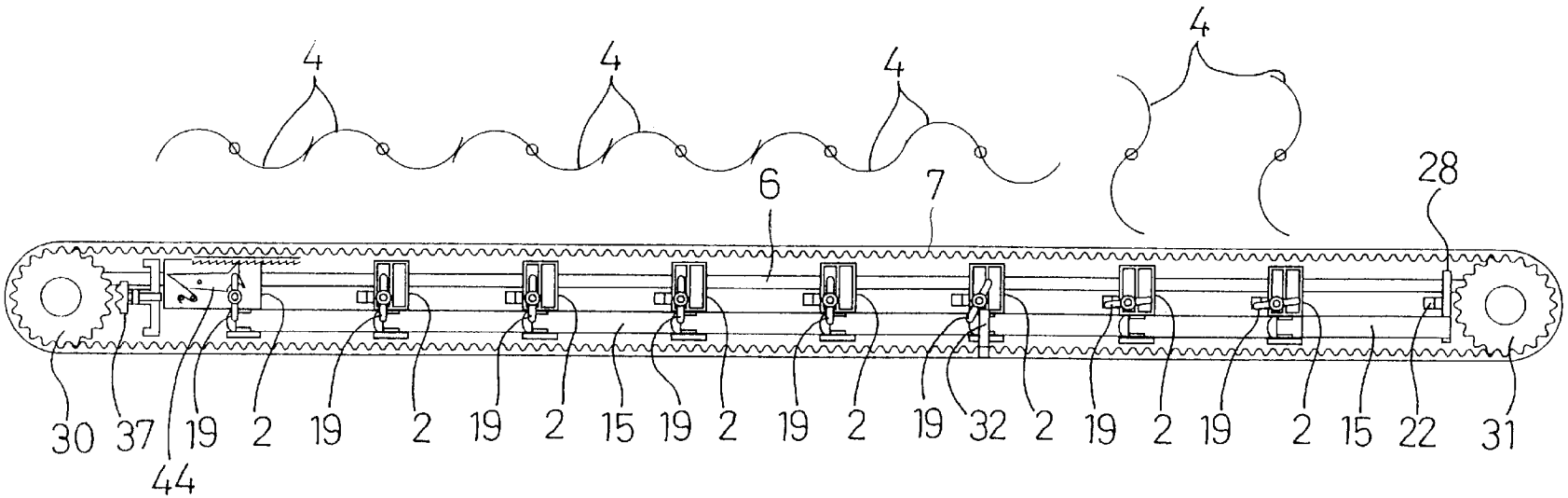
FIG. 19 is a general plan view showing a condition where orientation of the louvers are varied one by one from the condition shown in FIG. 18.
Figure 20:
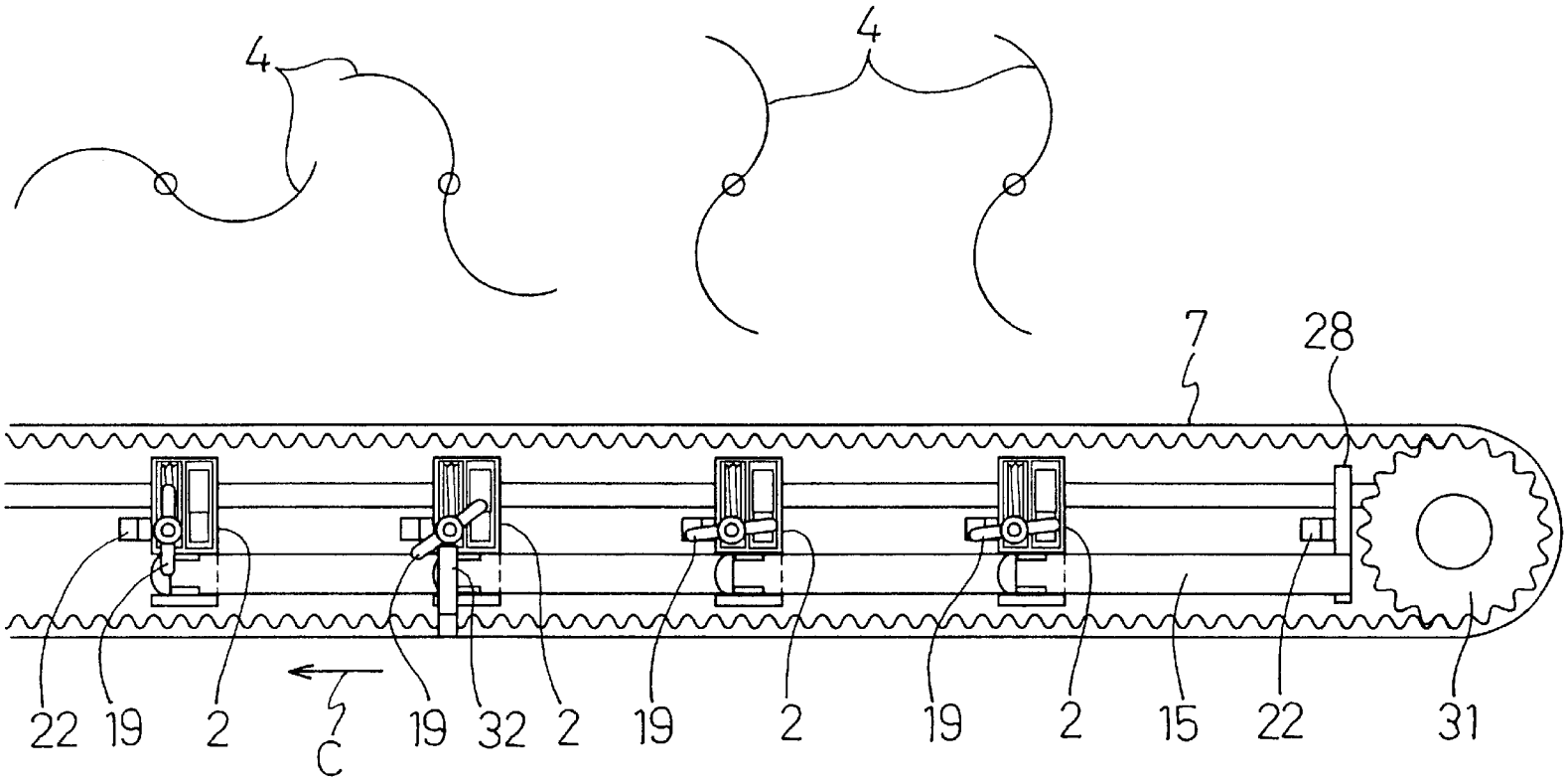
FIG. 20 is a partial plan view in the same condition.
Figure 21:
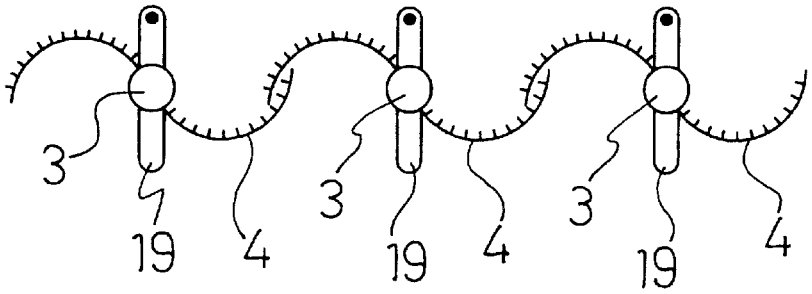
FIG. 21(1) to 21(3) is a diagrammatic illustration showing a transition state when orientation of all of louvers are varied all together.
Figure 21:
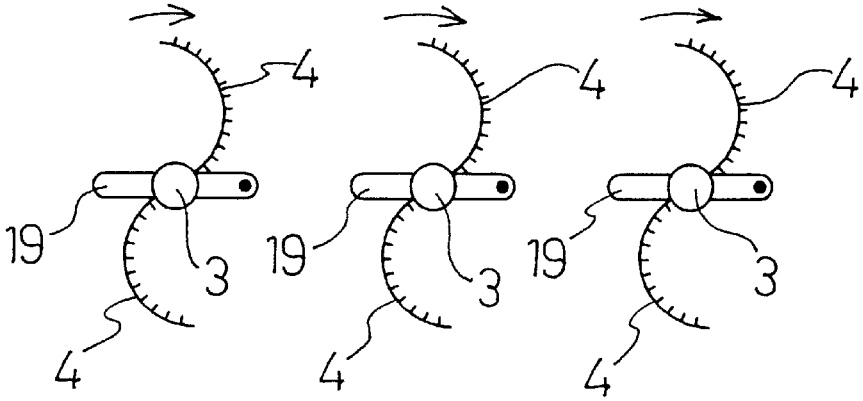
Figure 21:
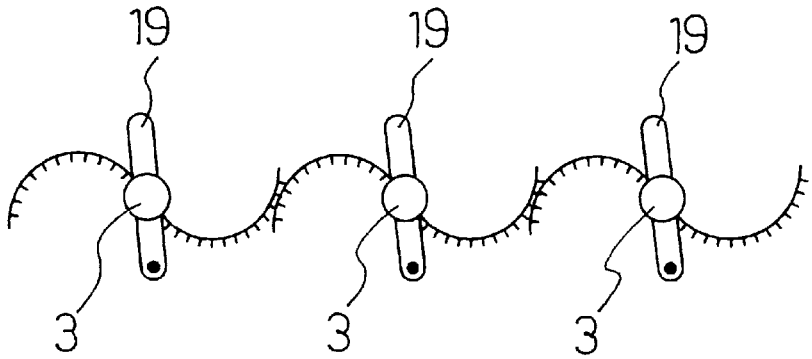

With orienting all of the louvers 4 in the condition oriented intersecting with the tilt shaft 6 shown in FIG. 16, all of the runners 2 are driven frontwardly in the maximum stroke. Then, the tilt shaft 6 is rotated to vary the orientation of all of the louvers 4 into the orientation parallel to the tilt shaft 6 as shown in FIG. 17, then the mutually mating curves of the louvers are fitted with each other to neatly overlap to completely close the window blind. At this time, the propellers 19 of all runners 2 are oriented to intersect with the tilt shaft 6. From this condition, by rotating the tilt shaft 6, all of the louvers 4 are rotated in clockwise direction in unison to reverse the front and rear surfaces of all louvers 4 (over about 180°). Then, as shown in FIG. 18, propellers 19 of all of the louvers 2 are rotated over about 180° to be oriented intersecting with the tilt shaft 6. In this case, the louvers 4 are mated in back-to-back relationship. Reversing operation of the louver 4 is diagrammatically illustrated as shown in FIGS. 21(1) to 21(3).

On the endless belt 7 for reversal of the louver, a louver reversing member 32 is fixed in inwardly projected fashion as shown in FIG. 18 in order to reverse each of the louver 4 in one-by-one basis from the condition shown in FIG. 18. When the endless belt 7 for reversing the louver is circulated, the louver reversing portion 32 is sequentially collide to the propeller 19 of the runner 2.

When the propeller 19 collides on the louver reversing member 32, the carrier 3 is rotated. In this case, the worm gear 17 provided on the carrier 3 is meshed with the worm gear 16 for integral rotation together with the tilt shaft 6 as set forth above. Due to slip (play) between the worm gear 17 and the worm gear 16, the tilt shaft 6 does not rotate for large load loaded on the tilt shaft 6, when only one carrier 3 is rotated. Only one carrier 3 whose propeller 19 is in collision with the louver reversing member 32, is rotated to vary orientation of one louver 4.

Accordingly, as shown in FIG. 18, when the louvers 4 are mated in back-to-back relationship, the endless belt 7 for reversing the louver is circulated in the direction of arrow C to collide the louver reversing member 32 to the propeller 19 from the runner 2 at the right end to the runner on the left side, sequentially in one-by-one basis. The runner 2, on which the louver reversing member 32 collides, is rotated the carrier 3 thereof in clockwise direction to orient the louver 4 intersecting with the tilt shaft 6. These operations are diagrammatically illustrated in FIGS. 22(1) and 22(2).

Figure 22:
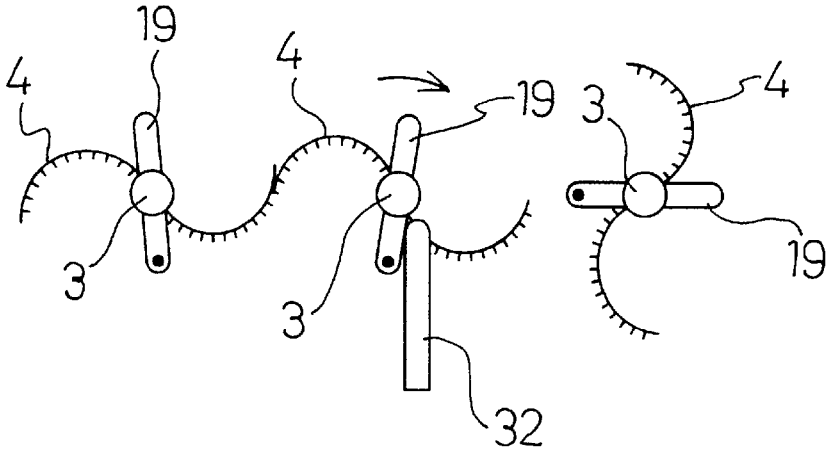
FIG. 22(1) to 22(3) is a diagrammatic illustration showing a transition state where orientation of the louvers are varied one by one.
Figure 22:
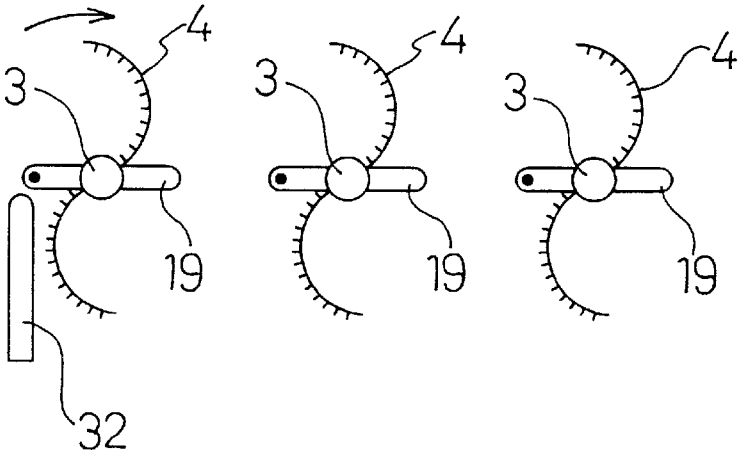
Figure 22:
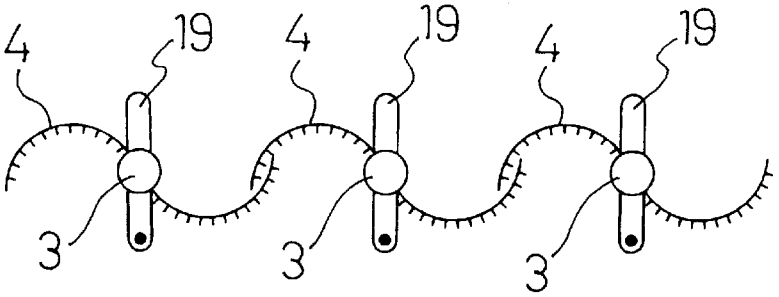

After orienting all of louvers 4 to intersect with the tilt shaft 6 as shown in FIG. 22(2), if the tilt shaft 6 is rotated to drive all of the louvers 4 to rotate in counterclockwise direction in unison, all of the louvers 4 are placed to fit the curves thereof to be neatly overlapped as shown in FIG. 22(3). In this case, all of the louvers 4 are placed in a condition reversed from the condition shown in FIG. 21(1).

Upon returning the orientation of all of the reversed louvers 4, the similar operation may be performed.

It is appropriate to perform reversal of the louvers 4 in the louver group in one-by-one basis when the window blind is fully closed and the distance between the louvers becomes maximum. Thus, in order to disable circulation of the endless belt 7 for reversing louver until the top runner (front most runner) 2*t* reaches the terminal end (left end of FIG. 4), rotation of the left side sprocket wheel 30 is restricted by means of the louver reversal restricting stopper mechanism 34, as shown in FIGS. 23 to 26. When the top runner 2*t* reaches the terminal end, rotation of the sprocket wheel 30 is restricted. Next, discussion will be given for the louver reversal restricting stopper mechanism 34.

Figure 23:
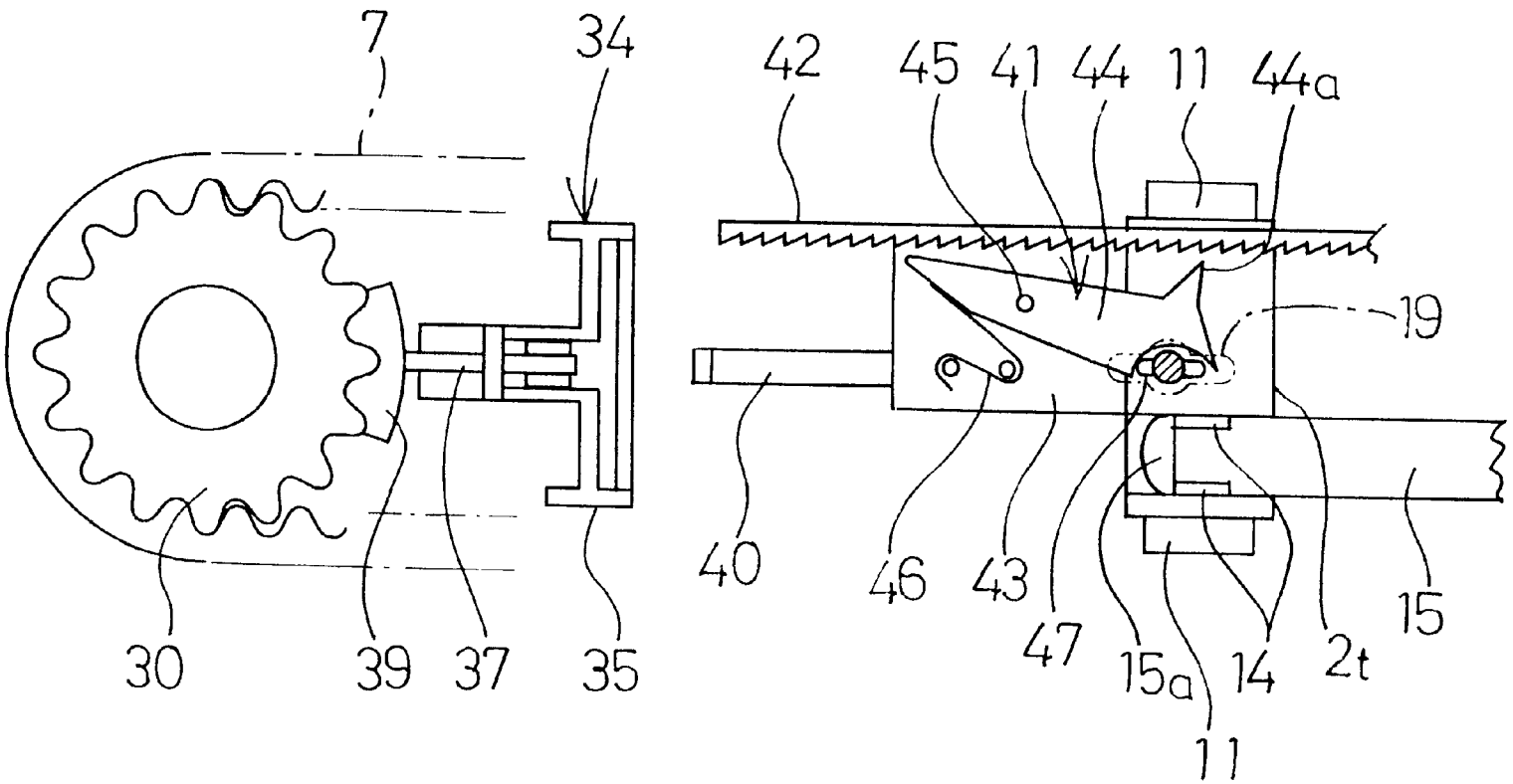
FIG. 23 is a general plan view of a stopper mechanism for restricting reversal of the louver and a stopper mechanism for restricting the runner.
Figure 24:
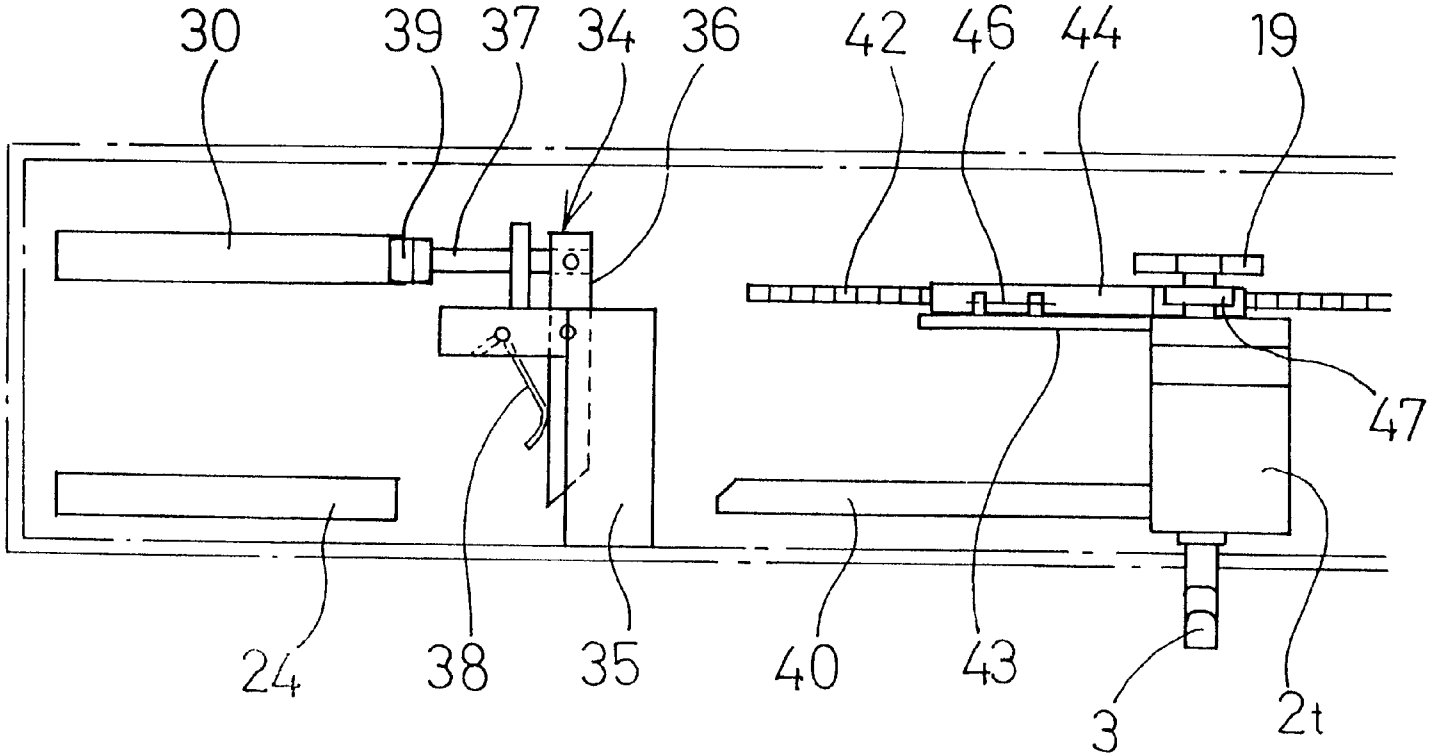
FIG. 24 is a general plan view of the stopper mechanisms.

On the inner side (within a rail side cap) of the left end portion of the rail 1, a stopper base 35 is fixed. A lever 36 is pivotably supported on the stopper base 35. Also, a louver reversal restricting stopper 37 is provided for back and forth movement toward the sprocket wheel 30 on left side as guided by the stopper base 35. Then, the lever 36 and the stopper 37 are connected by pin. On the other hand, the lever 36 is biased by a spring 38. Then, a gear portion 39 provided at the tip end of the stopper 37 is normally meshed with the sprocket wheel 30 on left side as shown in FIGS. 23 and 24.

Figure 25:
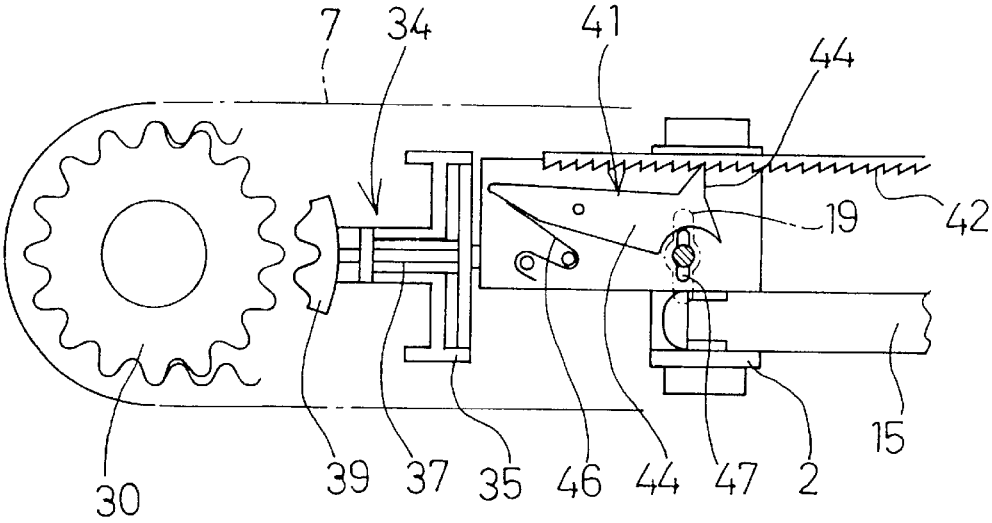
FIG. 25 is a general plan view of a stopper mechanism for restricting reversal of the louver and a stopper mechanism for restricting the runner in actuating condition.
Figure 26:
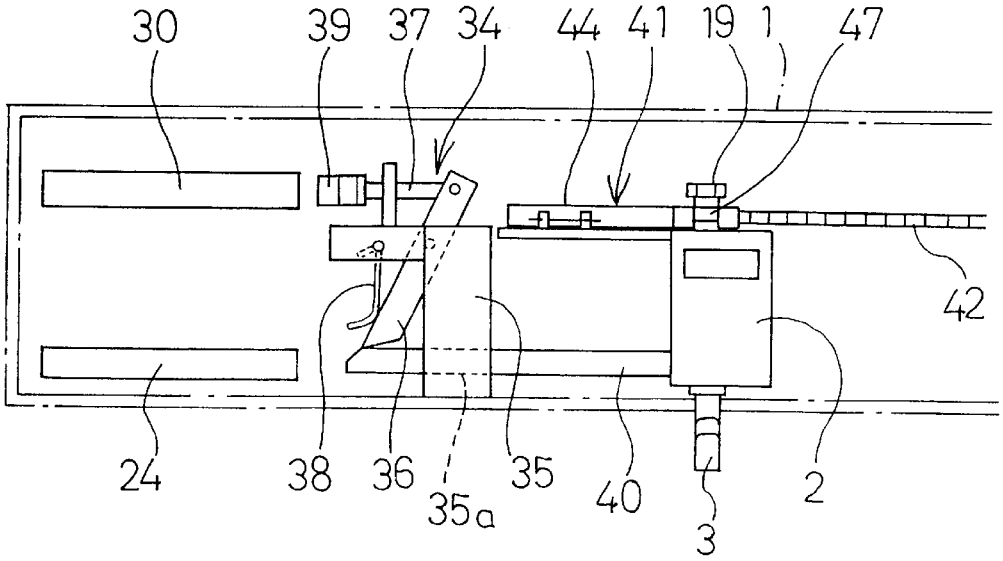
FIG. 26 is a general front elevation of the stopper mechanisms.

On the other hand, to the top runner 2*t*, a bar shaped stopper releasing member 40 is projected frontwardly in horizontal direction. When the top runner 2*t* reaches the terminal end (left end), the stopper releasing member 40 pushes the lower end portion of the lever 36 through a guide hole 35*a* defined in the stopper base 35 to cause pivot motion of the lever 36 against the spring 38. By pivot motion of the lever 36, the stopper 37 is retracted to release a teeth portion 39 from the sprocket wheel 30 on the left side as shown in FIGS. 25 and 26 to permit rotation of the sprocket wheel 30 and whereby to permit circulation of the endless belt 7 for reversal of the louver.

Accordingly, when the window blind is closed up to the position where the top runner 2*t* reaches the terminal end (left end), and when the louver reversing cord is operated to circulate the endless belt 7 for reversal of the louver, the orientation of the louvers in the louver group can be sequentially reversed in one-by-one basis.

Since the louver 4 is in reversed S shaped configuration in cross section, upon opening the window blind, if the louvers 4 are moved backwardly with maintaining a condition where the louvers 4 in the louver group are oriented to be parallel to the rail 1 to overlap the portions thereof, movement can be performed not smoothly. Therefore, when the orientation of the louvers 4 in the louver group is placed in the condition to be parallel to the rail 1 with overlapping the portions thereof, a runner restricting stopper mechanism 41 restricting travel of the top runner 2*t* is provided in the top runner 2*t* in order to restrict opening and closing operation of the window blind. Finally, the runner restricting stopper mechanism 41 will be discussed.

As shown in FIGS. 14 and 23, a saw tooth portion 42 is provided on the inner side surface of the rail 1. As shown in FIGS. 23 to 26, a stopper base plate 43 is fixed on the top runner 2*t*. On the stopper base plate 43, a runner restricting stopper 44 having a claw portion 44*a* is pivotably mounted by means of a pin 45 for pivot motion in horizontal direction. The stopper 44 is biased in a direction for preventing the claw portion 44*a* from engaging with the saw toothed member 42 of the rail 1 by a spring 46 mounted on the stopper base plate 43. On the other hand, for only carrier 3 of the top runner 3*t*, a cam (stopper actuating member) 47 which is smaller than the propeller 19 is fixed in the orientation with the propeller 19.

Since the cam 47 does not push the stopper 44 when the louver is oriented intersecting with the tilt shaft 6 as shown in FIGS. 4 and 16, as shown in FIG. 23, the stopper 44 is retracted to the position not engaging with the saw toothed member 42 of the rail 1 by the action of the spring 46. Accordingly, in this case, travel of the top runner 2*t* is permitted to enable opening and closing of the window blind.

However, as shown in FIG. 17, when the louver 4 is oriented to be parallel to the tilt shaft 6, the cam 47 pushes the stopper 44 to engage the claw portion 44*a* with the saw toothed portion 42 of the rail 1 as shown in FIG. 25 to restrict travel of the top runner 2*t* to disable opening and closing of the blind.

Modification of the preferred embodiment of the present invention set forth above will be discussed with reference to FIGS. 27 to 35.

Figure 29:
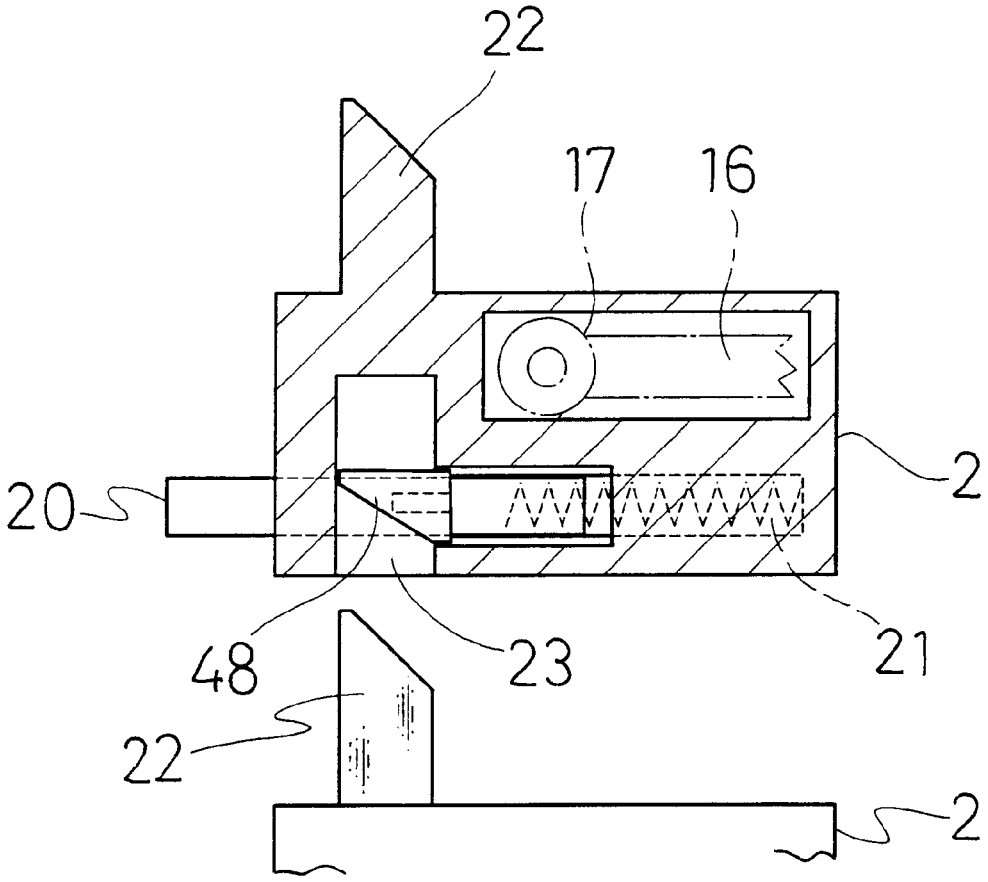
FIG. 29 is a section showing a condition before actuation of a belt connecting pin by a belt connecting pin actuating projection in the modification.
Figure 30:
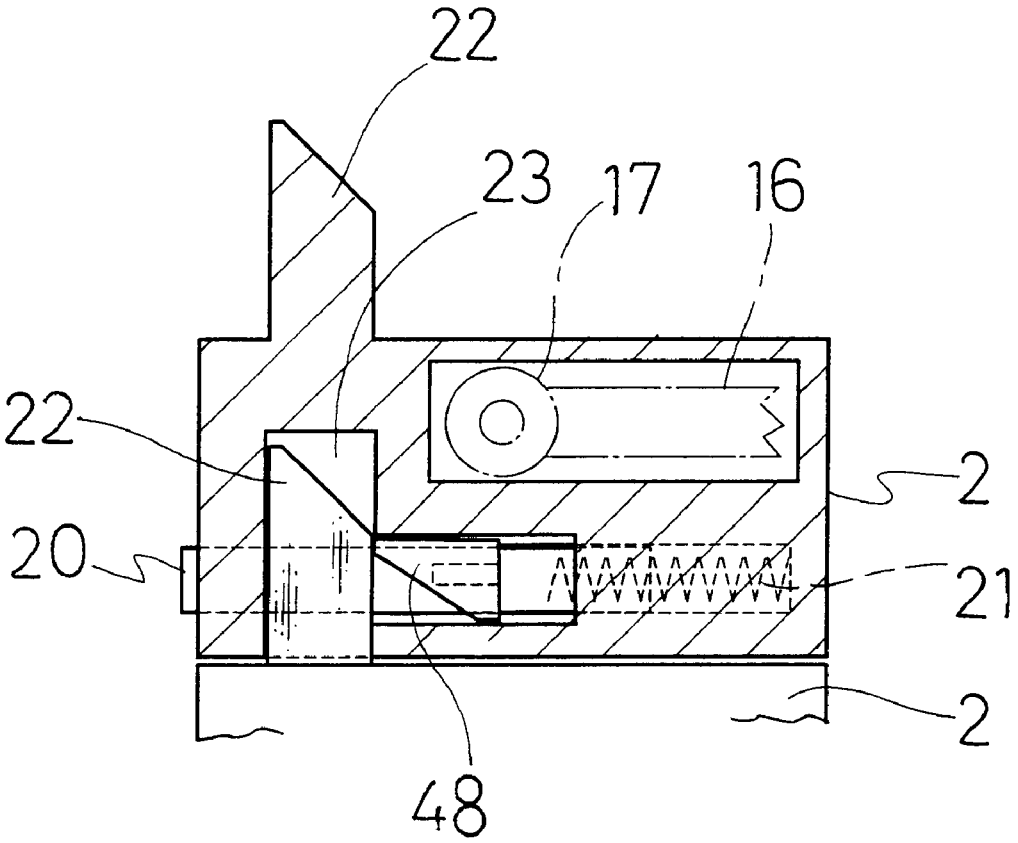
FIG. 30 is a section in a condition where the belt connecting pin is actuated by the belt connecting pin actuating projection.

In each runner 2, a cam 48 is fixed on the upper surface of the belt connection pin 20 per se. The cam 48 and the belt connection pin 20 have tilting portion. The belt connection pin actuating projection 22 of the immediately trailing runner 2 enters into the receptacle opening 23 to engage with the cam 48 as shown in FIGS. 29 and 30. Then, the belt connection pin 22 is directly retracted by the belt connection pin actuating projection 22 against the spring 21 to be withdrawn from the runner connection hole 26 of the endless belt 5 for driving the runner. With such construction, the mechanism to retract the belt connection pin 22 to withdraw from the runner connection hole 26 can be simpler than that of the foregoing embodiment, On the other hand, in order to certainly perform reversal of respective louvers 4 by sequentially colliding the louver reversing member 32 onto the propeller 19 in the condition where the propellers 19 of overall runners 2 are oriented perpendicular to the centerline of the rail 1, a propeller rotation stopper 49 restricting rotation of the propeller 19 is mounted in the following manner in each runner 2. Also, on tip end portion of the louver reversing member 32, a propeller rotation stopper releasing member 50 is fixed for releasing restriction by the propeller rotation stopper 49.

Figure 27:
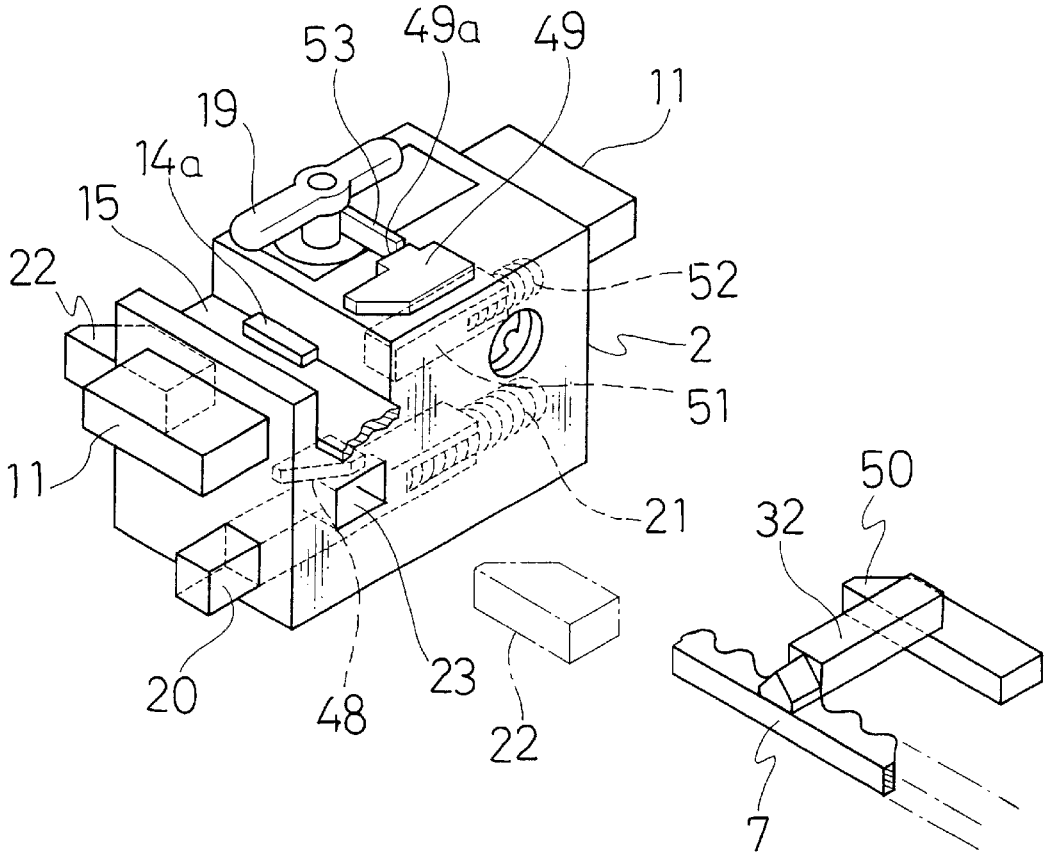
FIG. 27 is a perspective view showing modification of the embodiment of the present invention.
Figure 28:
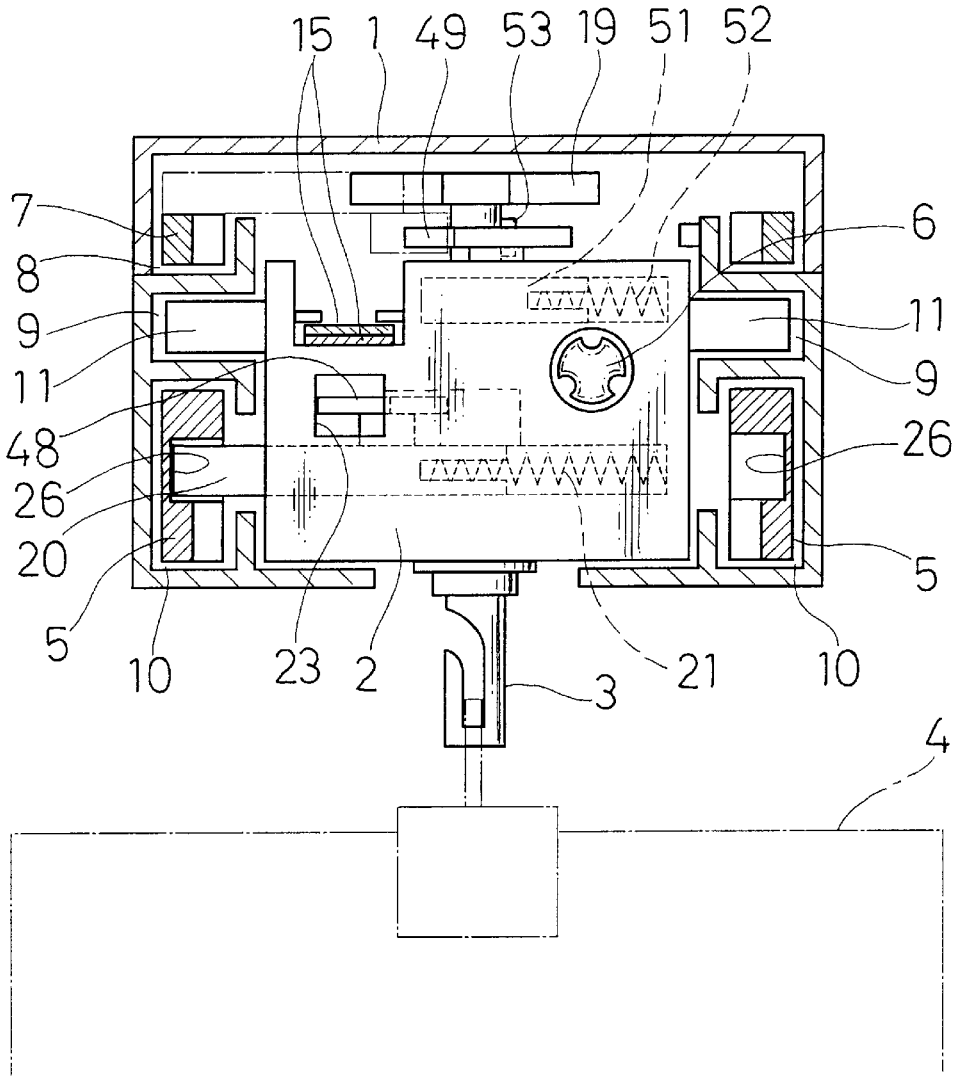
FIG. 28 is a sectional view of the modification.
Figure 31:
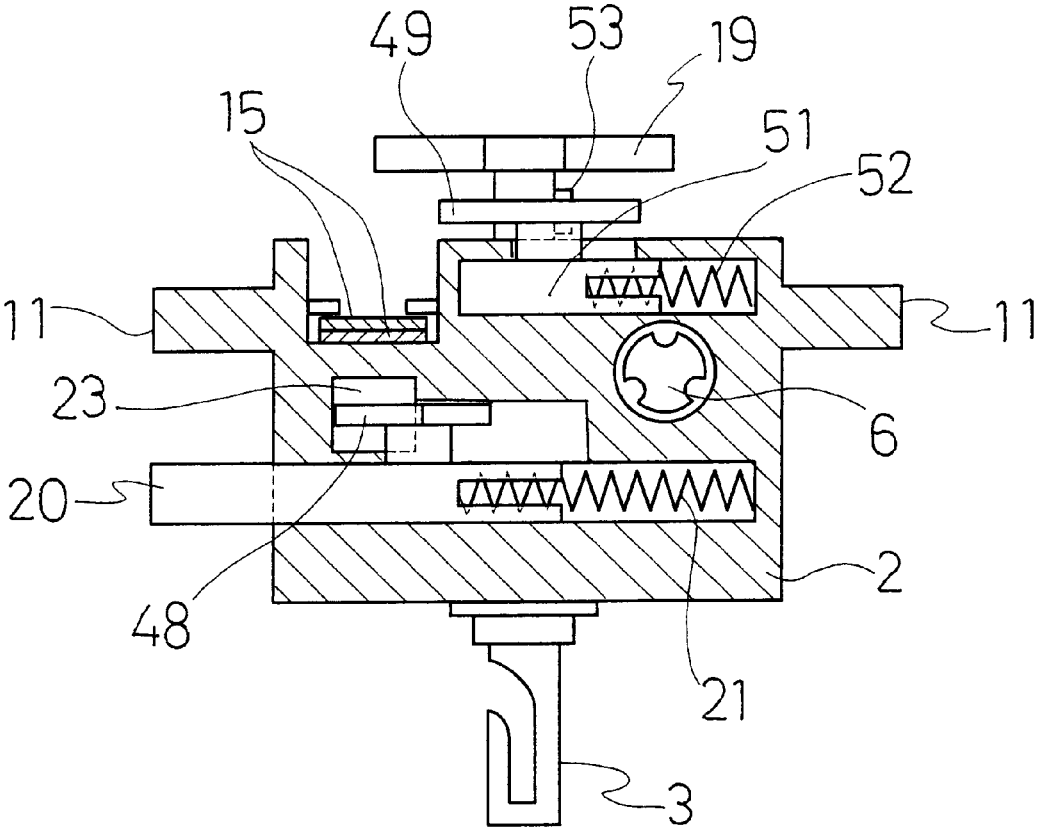
FIG. 31 is a section of the runner in the modification.
Figure 32:
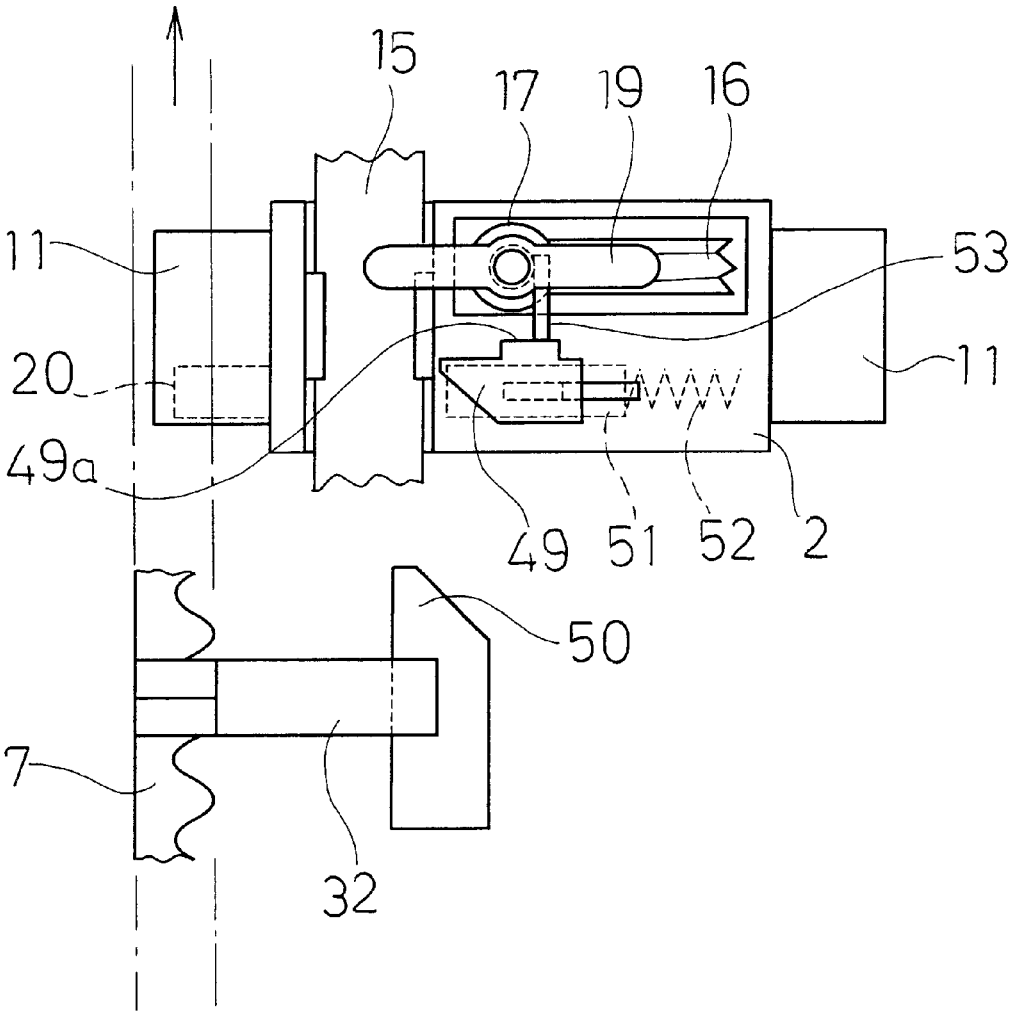
FIG. 32 is a plan view shows a part of sequence of process for rotating a propeller by a louver reversing member, and actuating a propeller rotation stopper by a propeller rotation stopper releasing member, before actuation.

The propeller rotation stopper 49 is fixed on the slider 51 which is slidably loaded in each runner 2, as shown in FIG. 31. The slider 51 is biased to a predetermined position by a spring 52. On the other hand, on a shaft of the propeller 19, a lever 53 is integrally fixed to the propeller 19 for rotation therewith. The tip end of the lever 53 contacts with a projecting portion 49*a* of the propeller rotation stopper 49, as shown in FIGS. 27 and 32. The propeller 19 is restricted rotation in the orientation perpendicular to the centerline of the rail 1. At this time, the orientation of the louver 4 becomes parallel to the rail 1.

Figure 33:
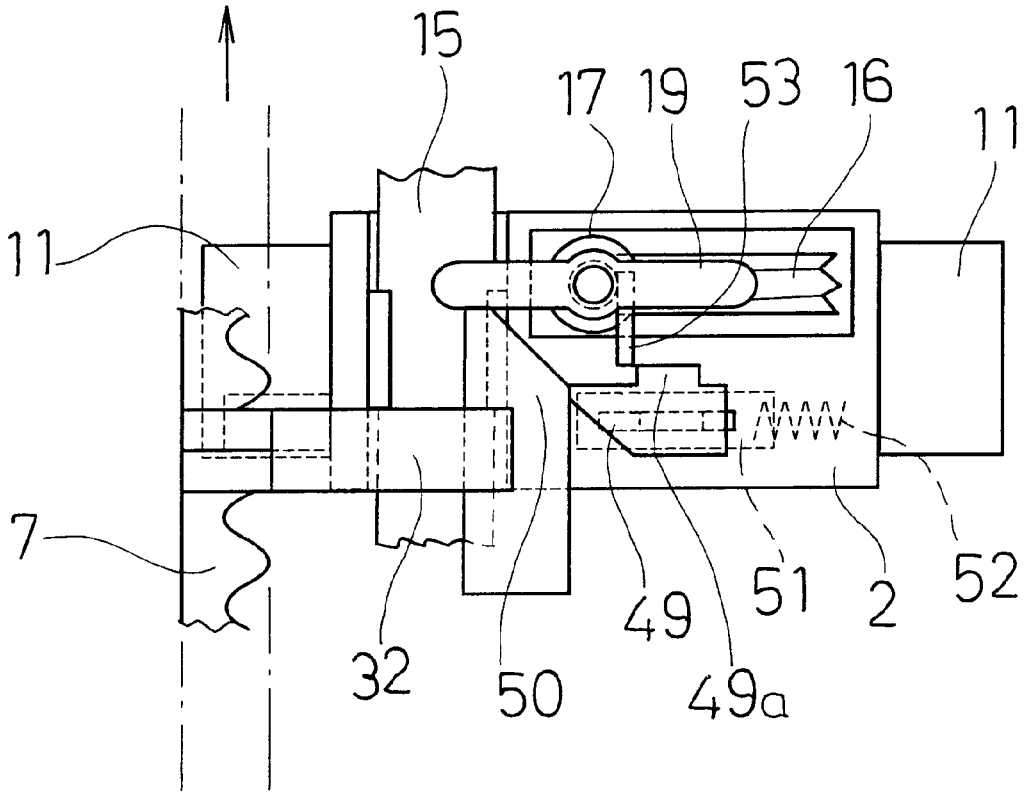
FIG. 33 is a plan view shows a part of sequence of process for rotating a propeller by a louver reversing member, and actuating a propeller rotation stopper by a propeller rotation stopper releasing member, where the propeller rotation stopper is actuated by the propeller rotation stopper releasing member.

By circulating the endless belt 7 for reversal of the runner from the condition shown in FIG. 32 to move the louver reversing member 32 in the same direction, the propeller rotation stopper releasing member 50 engages with the propeller rotation stopper 49 as shown in FIG. 33 to retract the propeller rotation stopper 49 against the spring 52 as shown in FIG. 33 to release the projecting portion 49*a* of the propeller rotation stopper 49 and the tip end of the lever 53. By this, the propeller 19 is permitted to rotate.

Figure 34:
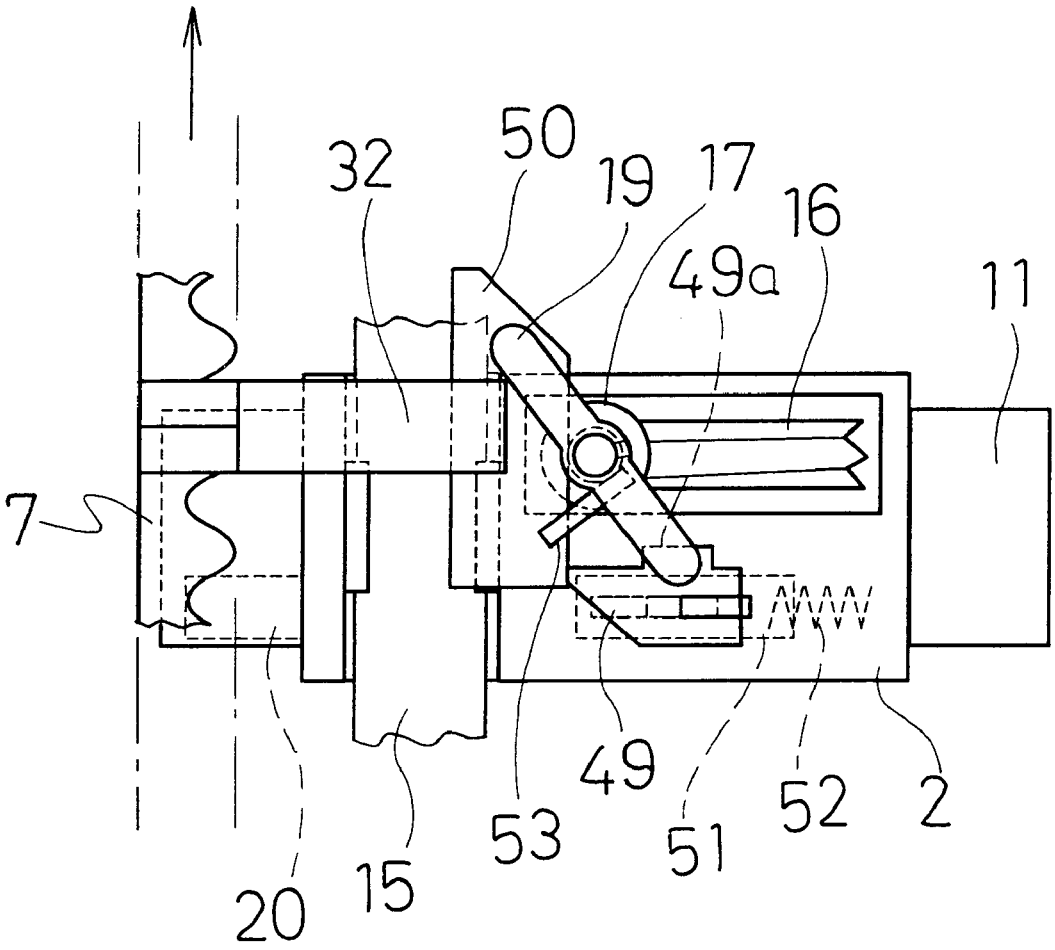
FIG. 34 is a plan view shows a part of sequence of process for rotating a propeller by a louver reversing member, and actuating a propeller rotation stopper by a propeller rotation stopper releasing member, where the propeller is rotated by a louver reversing member.
Figure 35:
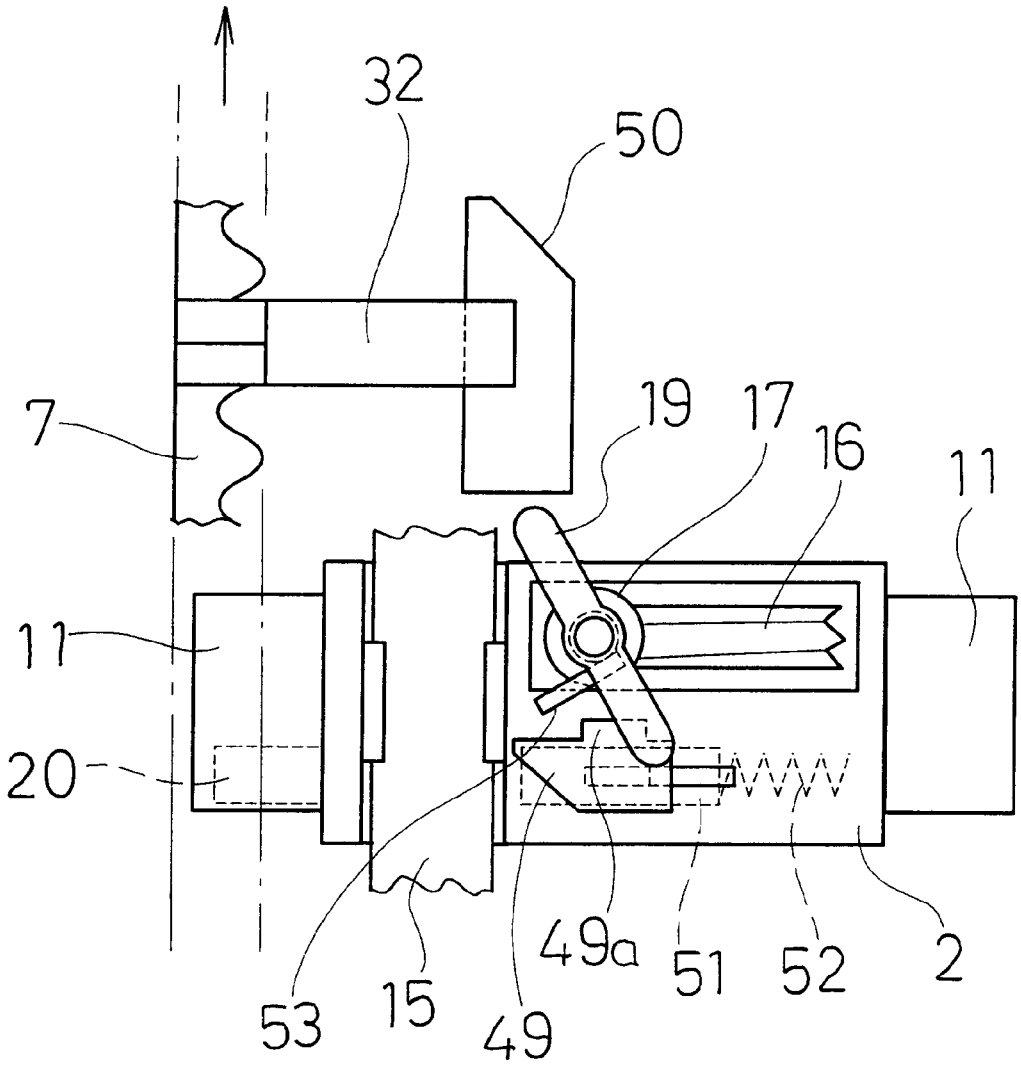
FIG. 35 is a plan view shows a part of sequence of process for rotating a propeller by a louver reversing member, and actuating a propeller rotation stopper by a propeller rotation stopper releasing member, after actuation.

When the louver reversing member 32 is further traveled, it collides on the propeller 19 as shown in FIG. 34 to rotate the propeller 19 in clockwise direction to reverse the louver 4. When the louver reversing member 32 is further driven to travel as shown in FIG. 35, the similar operation is performed in the next runner 2 to reverse the louvers 4 sequentially.

Although the present invention has been illustrated and described with respect to exemplary embodiments thereof, it should be understood by those skilled in the art that the foregoing and various changes, emission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims. For instance, the runner connecting portion of the endless belt 5 for driving the runner, is not limited to the hole (runner connection hole 26) as in the foregoing embodiments, but can be a projecting portion or step portion to engage with the belt connection pin 20.

With the present invention, when the window blind is to be opened, the louvers in the louver group can be drawn frontwardly from the end runner side sequentially conversely from the prior art, a problem of damaging of the runner or the drive shaft due to wearing can be resolved to provide good appearance when the window blind is opened to the midway.

With the present invention, since the runner cannot be driven to travel in the orientation of the louver closing the window blind (in the orientation to be parallel to the axis of the rail), and can be driven to travel in the orientation of the louver opening the window blind (in the orientation intersecting with the axis of the rail), opening and closing of the window blind can be performed without interference even when the shaped louvers, such as the louver having S shaped cross section, are employed.

Also, with the present invention, the louvers can be overlapped with neatly fitting the front and rear surfaces even when the front and rear surfaces are reversed even when the shaped louvers, such as the louver having S shaped cross section, are employed.

Furthermore, with the present invention, in the condition before rotating the carrier together with the propeller by the louver reversing member, the louvers in the louver group can be neatly oriented in the predetermined orientation to assure reversal of the louver by the louver reversing member.

At the midway of closing the window blind, namely until the top runner reaches the terminal end, the endless belt for reversing the louver cannot be circulated by the action of the louver reversal restricting stopper, and when the top runner reaches the terminal end to certainly provide sufficient interval between the louvers, restriction of the louver reversal restricting stopper can be released to permit circulation of the endless belt for reversing the louver to smoothly reversing the front and rear surfaces individually and sequentially.

Furthermore, if the window blind is opened and closed with maintaining the louvers in closing orientation, it is possible to damage the louvers due to collision with each other. The present invention can avoid such problem.

What is claimed is:

1. An opening and closing device for a window blind, in which louvers are hanged on carriers respectively carried by runners in a runner group traveling along a rail for opening and closing the group of louvers, and the carriers are rotated by a tilt shaft extending through the runner group for varying orientation of the louvers in unison, comprising:

a runner driving endless belt for driving said runners;

runner connecting portions provided with a given interval on said runner driving endless belt;

belt connecting pins provided in respective runners and movable between engaging positions to engage with said runner connecting portions and retracted positions released away from said runner connecting portions;

springs for biasing respective of said belt connecting pins to said engaging positions for engaging with said runner connecting portion;

receptacle openings on rear surfaces of respective runners; and belt connecting pins actuating projections provided on front surface of said runners and entering into said receptacle openings for driving said belt connecting pins to said retracted position against a force exerted by said springs when a preceding runner is stacked on a following runner.

2. An opening and closing device for a window blind as set forth in claim 1, wherein said runner connecting portions of said runner driving endless belt are holes.

3. An opening and closing device for a window blind as set forth in claim 1, wherein a pinion rotatable about said tilt shaft for varying orientation of the louvers in said louver group in unison and a cam for rotating said pinion by engaging with said belt connecting pin actuating projection projecting from said receptacle opening, are provided within each runner and a rack portion meshing with said pinion is provided on said belt connecting pin.

4. An opening and closing device for a window blind as set forth in claim 1, wherein a cam engaging with said belt connecting pin actuating projection projecting from said receptacle opening for retracting said belt connecting pin against said spring, is provided on said belt connecting pin.

5. An opening and closing device for a window blind as set forth in claim 1, wherein an end stopper is fixed to one end in said rail and a belt connecting pin actuating projection is provided for retracting a belt connecting pin of a runner which is at an end of the runner group by projecting into a receptacle opening of said runner which is at an end of the runner group.

6. An opening and closing device for a window blind as set forth in claim 1, wherein said runners include a top runner arranged at a leading end among said runners, and a runner restricting stopper is provided on said runner for restricting travel of said top runner relative to the rail and for releasing said top runner from a restricted state, and a stopper actuating member is provided on said top runner for actuating said runner restricting stopper to a travel restricting position when said louvers are oriented in a closing orientation and for actuating said runner restricting stopper to a released position when said louvers are oriented in an opening orientation.

7. An opening and closing device for a window blind as set forth in claim 1, wherein a propeller is fixed on said carrier of each runner, and a louver reversing member is projected from a louver reversing endless belt which can circulate along the rail for sequentially rotating each individual carrier together with the propeller by colliding with said propeller.

8. An opening and closing device for a window blind as set forth in claim 7, wherein a propeller rotation stopper restricting rotation of the propeller at an orientation with a given angle relative to the rail, is provided on each runner, and a propeller stopper releasing member releasing said propeller rotation stopper to permit rotation of said propeller is provided on said louver reversing member.

9. An opening and closing device for a window blind as set forth in claim 7, wherein said louver reversing endless belt is wound around sprocket wheels rotatably supported on said rail, a louver reversal restricting stopper for restricting rotation of one of said sprocket wheels and for releasing restriction of said one of said sprocket wheels is provided on said rail, and a stopper releasing member for retracting said louver reversal restricting stopper to a released position is provided on said top runner.

10. An opening and closing device for a window blind as set forth in claim 7, wherein a runner restricting stopper which can restrict travel of the top runner relative the rail and releasing restriction is provided on said top runner and a stopper actuating member is provided on said carrier of said top runner for actuating said runner restricting stopper to a traveling restricting position when the louver is oriented in a closing orientation and for actuating said runner restricting stopper to a released position when the louver is oriented in an opening orientation.

11. An opening and closing device for a window blind as set forth in claim 7, wherein said louvers have a reversed S shaped cross section.

* * * * *